US011469558B2

(12) United States Patent
Tada et al.

(10) Patent No.: US 11,469,558 B2
(45) Date of Patent: Oct. 11, 2022

(54) CONNECTOR AND ELECTRONIC EQUIPMENT

(71) Applicants: JAPAN AVIATION ELECTRONICS INDUSTRY, LIMITED, Tokyo (JP); SHARP KABUSHIKI KAISHA, Osaka (JP)

(72) Inventors: Takashi Tada, Tokyo (JP); Kazutaka Okuzako, Osaka (JP); Motoo Gohda, Osaka (JP); Hideto Ohhori, Osaka (JP)

(73) Assignees: JAPAN AVIATION ELECTRONICS INDUSTRY, LIMITED, Tokyo (JP); SHARP KABUSHIKI KAISHA, Sakai (JP)

( * ) Notice: Subject to any disclaimer, the term of this patent is extended or adjusted under 35 U.S.C. 154(b) by 31 days.

(21) Appl. No.: 17/209,457

(22) Filed: Mar. 23, 2021

(65) Prior Publication Data

US 2021/0320465 A1 Oct. 14, 2021

(30) Foreign Application Priority Data

Apr. 9, 2020 (JP) ..... JP2020-070308

(51) Int. Cl.
*H01R 24/60* (2011.01)
*H01R 12/71* (2011.01)

(52) U.S. Cl.
CPC ..... *H01R 24/60* (2013.01); *H01R 12/71* (2013.01)

(58) Field of Classification Search
None
See application file for complete search history.

(56) References Cited

U.S. PATENT DOCUMENTS

| | | | | |
|---|---|---|---|---|
| 8,738,097 | B2 | 5/2014 | Hong | |
| 9,831,615 | B2 | 11/2017 | Saito et al. | |
| 9,979,107 | B1 | 5/2018 | Otani | |
| 10,218,126 | B2 | 2/2019 | Kurosawa | |
| 10,547,133 | B1 * | 1/2020 | Consoli | G02B 6/4269 |
| 10,693,259 | B2 | 6/2020 | Ho et al. | |

(Continued)

FOREIGN PATENT DOCUMENTS

| | | | |
|---|---|---|---|
| JP | 2009176734 | A | 8/2009 |
| JP | 2016100145 | A | 5/2016 |

(Continued)

*Primary Examiner* — Oscar C Jimenez
(74) *Attorney, Agent, or Firm* — Holtz, Holtz & Volek PC

(57) ABSTRACT

A connector is mateable with a mating connector along a front-rear direction. The connector comprises a first sub connector and a second sub connector. The first sub connector and the second sub connector are mateable with each other in a direction intersecting with the front-rear direction. The first sub connector comprises a first holding member and a plurality of first terminals. The second sub connector comprises a second holding member and a plurality of second terminals. The second terminals are arranged in two rows. Each of the second terminals has a second contact point and an SMT portion. The SMT portion is configured to be fixed on a circuit board. The SMT portion of the second terminal of one of the two rows extends in an orientation opposite to an orientation in which the SMT portion of the second terminal of a remaining one of the two rows extends.

9 Claims, 13 Drawing Sheets

(56) References Cited

U.S. PATENT DOCUMENTS

| | | | | |
|---|---|---|---|---|
| 2001/0014563 | A1* | 8/2001 | Morita | H01R 12/716 439/676 |
| 2007/0072444 | A1* | 3/2007 | Okuyama | H01R 12/716 439/65 |
| 2012/0021622 | A1* | 1/2012 | Lee | H01R 12/716 439/74 |

FOREIGN PATENT DOCUMENTS

| | | | |
|---|---|---|---|
| JP | 2017021899 | A | 1/2017 |
| JP | 2017091774 | A | 5/2017 |
| JP | 6276825 | B2 | 1/2018 |
| JP | 2018081873 | A | 5/2018 |
| TW | M541662 | U | 5/2017 |
| WO | 2018022076 | A1 | 2/2018 |

* cited by examiner

CONNECTOR AND ELECTRONIC EQUIPMENT

CROSS REFERENCE TO RELATED APPLICATIONS

This application is based on and claims priority under 35 U.S.C. § 119 to Japanese Patent Application No. JP2020-070308 filed Apr. 9, 2020, the contents of which are incorporated herein in their entirety by reference.

BACKGROUND OF THE INVENTION

This invention relates to a connector mateable with a mating connector, and to an electronic equipment comprising the connector.

Referring to FIGS. 24 and 25, JPA2017-21899 (Patent Document 1) discloses a connector 900. Specifically, the connector 900 is configured to be mounted on a circuit board 980 and is mateable with a mating connector (not shown) along an X-direction. The circuit board 980 has pads 982, 986. The pad 982 is positioned in a negative X-direction beyond the pad 986. The connector 900 comprises a mating portion 905, a holding member 910 and terminals 950. Specifically, the holding member 910 has a plate-like portion 912, and each of the terminals 950 has a substantially L-like shape. When the connector 900 is mounted on the circuit board 980, the mating portion 905 protrudes beyond a positive X-end of the circuit board 980. The terminals 950 are grouped into two groups including a group of upper terminals 960 and a group of lower terminals 970. Each of the upper terminals 960 has a contact portion 962 and a surface mount technology (SMT) portion 966. The contact portion 962 is arranged on an upper surface 9122 of the plate-like portion 912. The SMT portion 966 is soldered on the pad 982 of the circuit board 980 when the connector 900 is mounted on the circuit board 980. Each of the lower terminals 970 has a contact portion 972 and an SMT portion 976. The contact portion 972 is arranged on a lower surface 9126 of the plate-like portion 912. The SMT portion 976 is soldered on the pad 986 of the circuit board 980 when the connector 900 is mounted on the circuit board 980. When the connector 900 mounted on the circuit board 980 is viewed from its positive Z-side, the SMT portion 976 of the lower terminal 970, which is soldered on the pad 986, is invisible because the upper terminal 960 hides the SMT portion 976. Similarly, when the connector 900 mounted on the circuit board 980 is viewed from its negative X-side, the SMT portion 976 of the lower terminal 970, which is soldered on the pad 986, is invisible because the upper terminal 960 hides the SMT portion 976.

When the soldering operation is done in a state where the connector 900 simply rests on the circuit board 980 so that the mating portion 905 protrudes beyond the positive X-end of the circuit board 980, the connector 900 is tilted relative to the circuit board 980 by the weight of the mating portion 905. This makes difficult to solder the SMT portion 966, 976 of the connector 900 on the pad 982, 986 of the circuit board 980 in a state where the connector 900 rests on the circuit board 980, and this might cause the SMT portion 966, 976 to be poorly soldered on the pad 982, 986.

In addition, the SMT portion 976 of the lower terminal 970, which is soldered on the pad 986 of the circuit board 980, is hidden by the upper terminal 960 as described above. Accordingly, if the SMT portion 976 of the lower terminal 970 is poorly soldered on the pad 986, it is a difficult matter to resolder the SMT portion 976 on the pad 986. Specifically, if the SMT portion 976 of the lower terminal 970 is poorly soldered on the pad 986, the circuit board 980, on which the connector 900 is mounted, itself must be discarded as defective. This increases the manufacturing costs of the connector 900 and the circuit board 980.

SUMMARY OF THE INVENTION

It is therefore an object of the present invention to provide a connector which enables its SMT portion to be easily soldered on a circuit board and which enables its SMT portion to be resoldered on a circuit board if the SMT portion is poorly soldered on the circuit board.

One aspect (first aspect) of the present invention provides a connector mateable with a mating connector along a front-rear direction. The mating connector comprises a plurality of mating terminals. The connector comprises a first sub connector and a second sub connector. The first sub connector and the second sub connector are mateable with each other in a direction intersecting with the front-rear direction. The first sub connector comprises a first holding member and a plurality of first terminals. The first holding member has at least a plate-like portion. The plate-like portion has an upper surface and a lower surface. The first terminals are brought into contact with the mating terminals, respectively, when the connector and the mating connector are mated with each other. The first terminals include a plurality of upper terminals and a plurality of lower terminals. Each of the upper terminals has an upper contact portion, an upper extending portion and a first upper contact point. The upper contact portion extends in the front-rear direction and is arranged on the upper surface of the plate-like portion. The upper extending portion extends in a direction intersecting with the front-rear direction. The upper extending portion has an end portion. The first upper contact point is provided at the end portion of the upper extending portion. Each of the lower terminals has a lower contact portion, a lower extending portion and a first lower contact point. The lower contact portion extends in the front-rear direction and is arranged on the lower surface of the plate-like portion. The lower extending portion extends in a direction intersecting with the front-rear direction. The lower extending portion has an end portion. The first lower contact point is provided at the end portion of the lower extending portion. The second sub connector is configured to be mounted on a circuit board. The second sub connector comprises a second holding member and a plurality of second terminals. The second holding member holds the second terminals. The second terminals are arranged in two rows. Each of the second terminals has a second contact point and an SMT portion. The second contact point of the second terminal of one of the two rows is brought into contact with the first upper contact point under a mated state where the first sub connector and the second sub connector are mated with each other. The second contact point of the second terminal of a remaining one of the two rows is brought into contact with the first lower contact point under the mated state where the first sub connector and the second sub connector are mated with each other. The SMT portion is configured to be fixed on the circuit board. The SMT portion of the second terminal of the one of the two rows extends in an orientation opposite to an orientation in which the SMT portion of the second terminal of the remaining one of the two rows extends.

Another aspect (second aspect) of the present invention provides an electronic equipment comprising the connector of the first aspect, the circuit board and a housing. The connector is mounted on the circuit board. The circuit board is attached to an inside of the housing. The housing is provided with a receiving portion which communicates with an outside of the housing. The plate-like portion is positioned in the receiving portion.

The connector of the present invention comprises the first sub connector and the second sub connector. In addition, the first sub connector and the second sub connector are mateable with each other in the direction intersecting with the front-rear direction, and the second sub connector is configured to be mounted on a circuit board. Accordingly, the connector of the present invention is configured so that the whole of the connector can be mounted on a circuit board by the first sub connector being mated with the second sub connector after the mounting of the second sub connector on the circuit board. Thus, in the connector of the present invention, the SMT portion can be easily soldered on a circuit board.

In addition, the second sub connector of the connector of the present invention is configured so that the SMT portion of the second terminal of the one of the two rows extends in the orientation opposite to the orientation in which the SMT portion of the second terminal of the remaining one of the two rows extends. Thus, even without the second sub connector having an increased size in a pitch direction, the connector of the present invention can allow the SMT portion to be easily resoldered on a circuit board when the SMT portion is poorly soldered on the circuit board.

An appreciation of the objectives of the present invention and a more complete understanding of its structure may be had by studying the following description of the preferred embodiment and by referring to the accompanying drawings.

Figure 1:
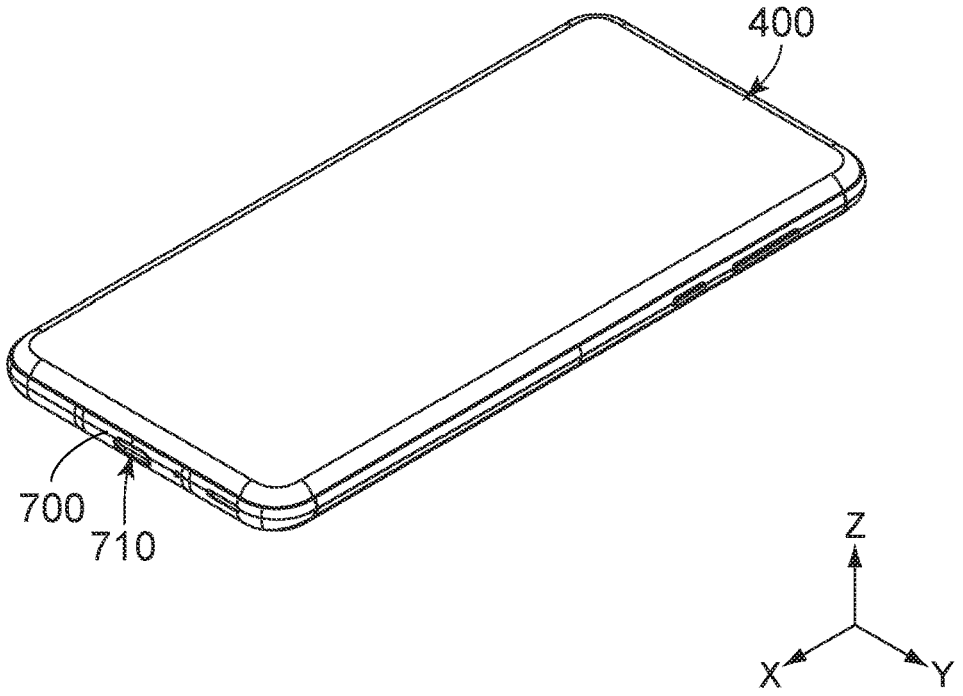
FIG. 1 is a perspective view showing an electronic equipment according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 6:
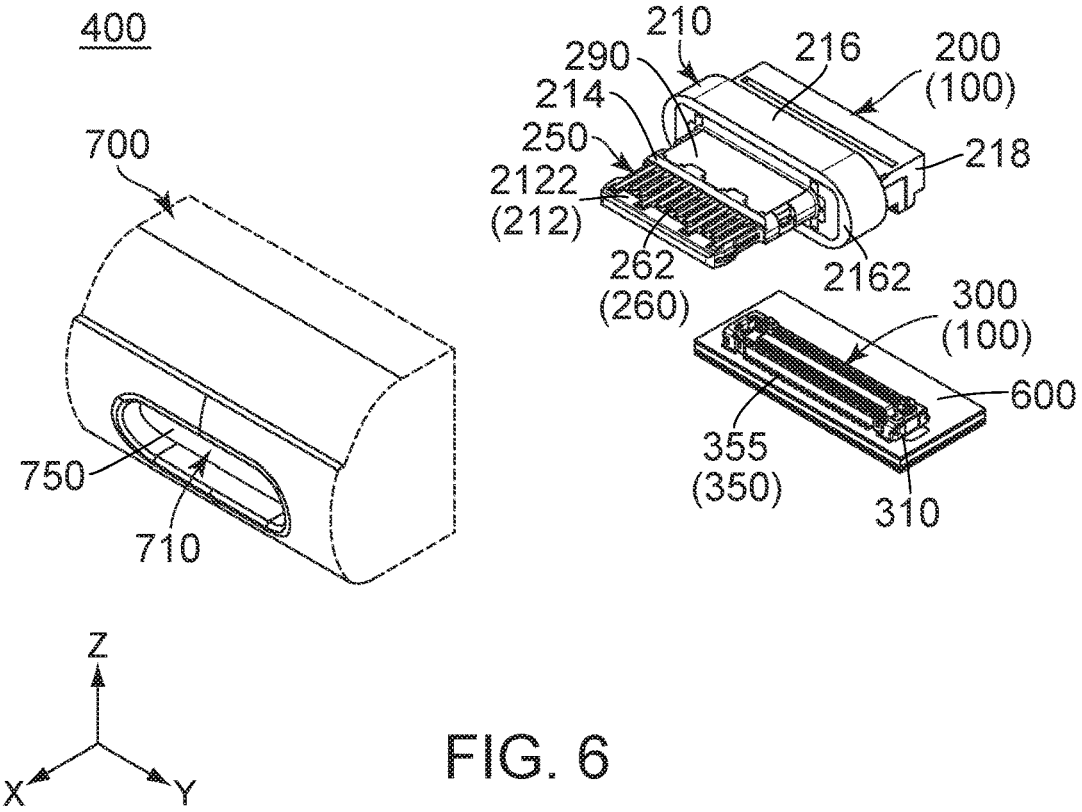
FIG. 6 is an exploded, cross-sectional view showing the electronic equipment of FIG. 2.

As shown in FIGS. 1 and 6, an electronic equipment 400 according to an embodiment of the present invention comprises a connector 100, a housing 700 and a circuit board 600. In each of FIGS. 2, 3 and 6, the housing 700 and the circuit board 600 are only partially shown.

Figure 2:
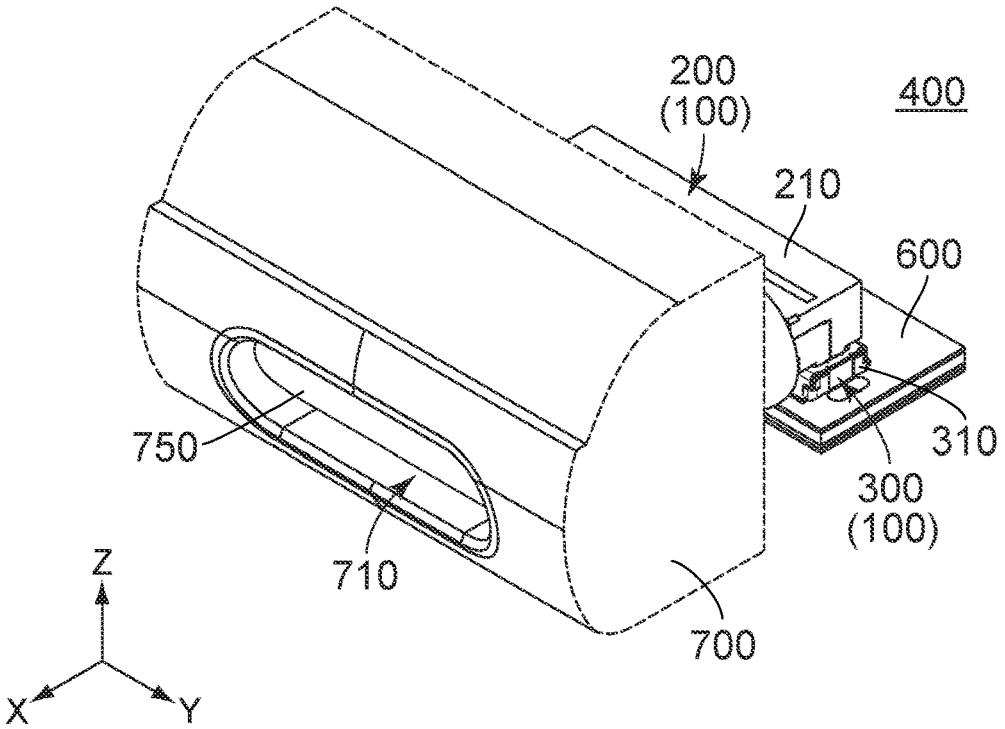
FIG. 2 is a perspective view showing a part of the electronic equipment of FIG. 1.
Figure 4:
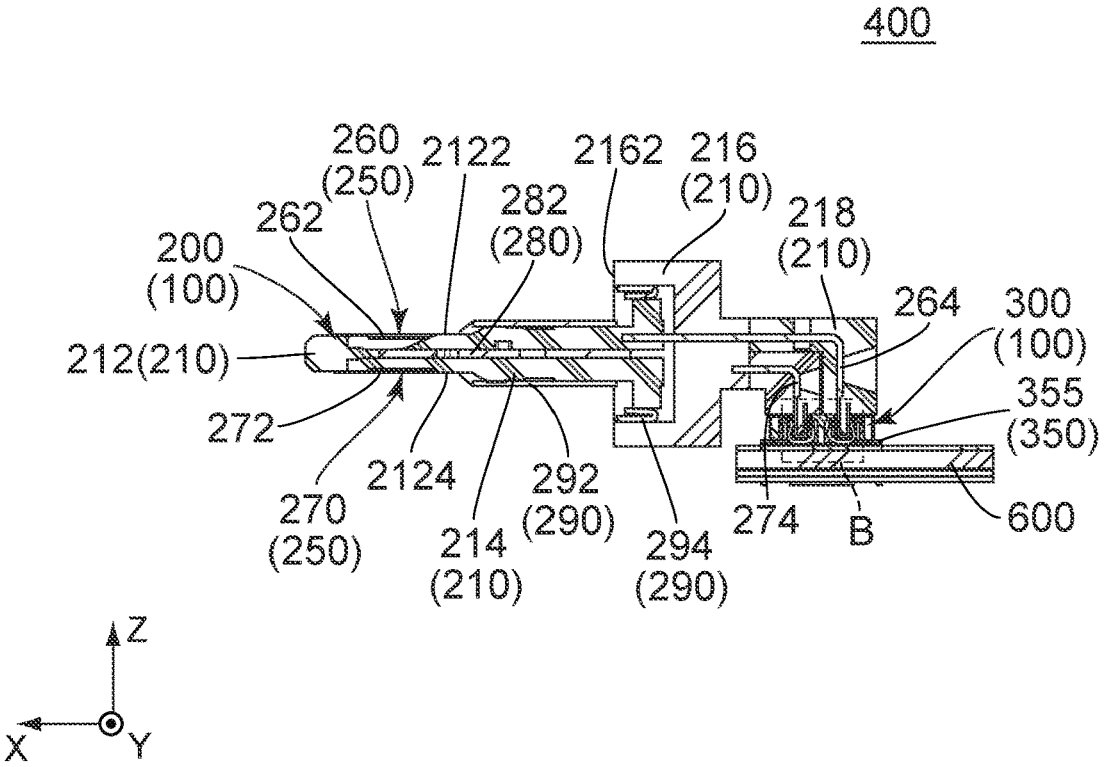
FIG. 4 is a cross-sectional view showing the electronic equipment of FIG. 3. In the figure, a housing and a shell are omitted while a circuit board is partially illustrated.

Referring to FIGS. 2 and 4, the connector 100 according to the present embodiment is mounted on the circuit board 600. The connector 100 is mateable with a mating connector (not shown), which comprises a plurality of mating terminals (not shown), along a front-rear direction. More specifically, the connector 100 of the present embodiment is a receptacle whose terminals are arranged in the same manner as those of a USB (Universal Serial Bus) Type-C receptacle. In the present embodiment, the front-rear direction is an X-direction. Specifically, it is assumed that forward is a positive X-direction while rearward is a negative X-direction.

Figure 7:
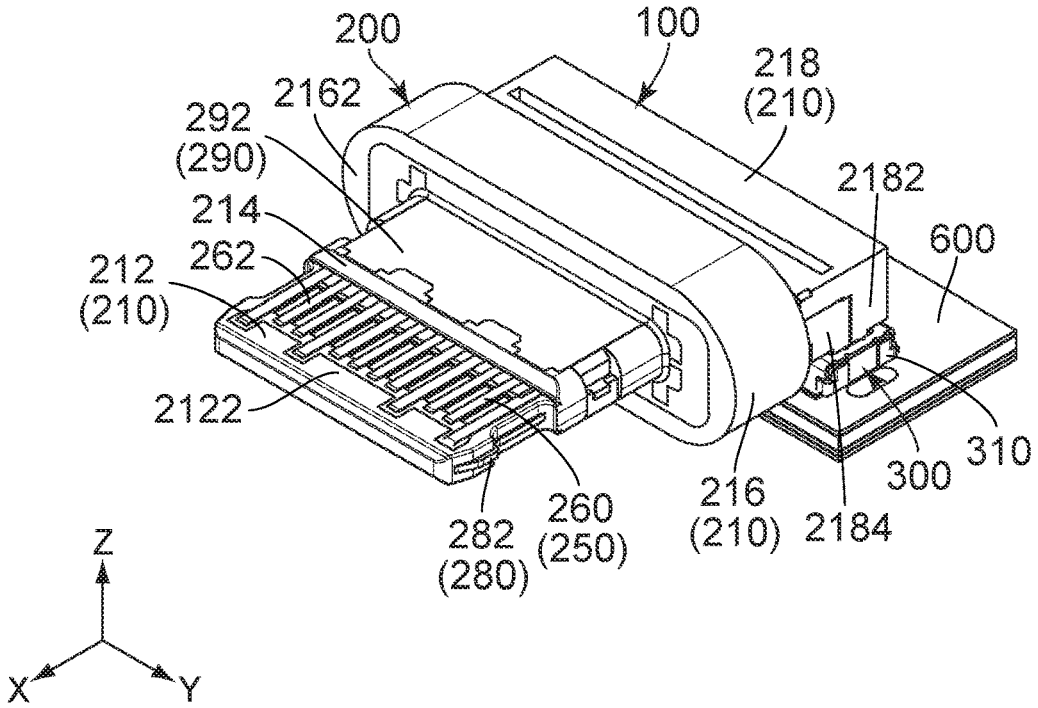
FIG. 7 is a perspective view showing a connector and the circuit board which are included in the electronic equipment of FIG. 2.

As shown in FIG. 7, the connector 100 of the present embodiment comprises a first sub connector 200 and a second sub connector 300. More specifically, the connector 100 consists of the first sub connector 200 and the second sub connector 300. The first sub connector 200 and the second sub connector 300 are mateable with each other in a direction intersecting with the front-rear direction. More specifically, the first sub connector 200 and the second sub connector 300 are mateable with each other in an up-down direction perpendicular to the front-rear direction. In the present embodiment, the up-down direction is a Z-direction. Specifically, it is assumed that upward is a positive Z-direction while downward is a negative Z-direction.

Figure 8:
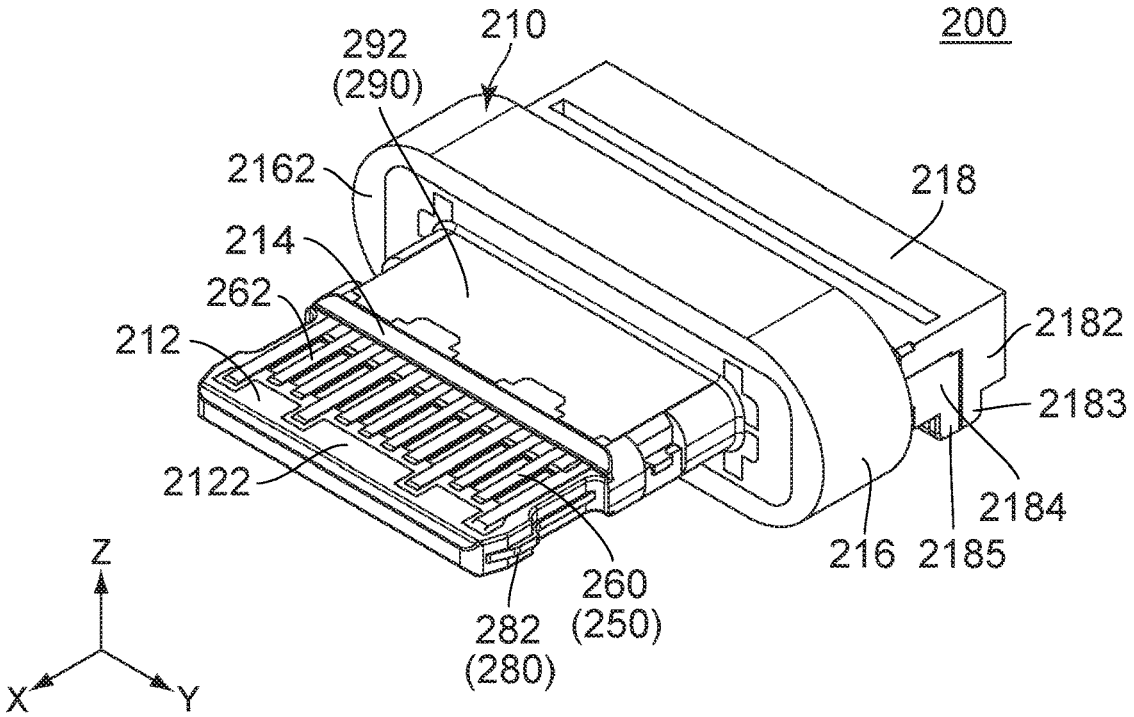
FIG. 8 is a top, perspective view showing a first sub connector which is included in the electronic equipment of FIG. 6.
Figure 9:
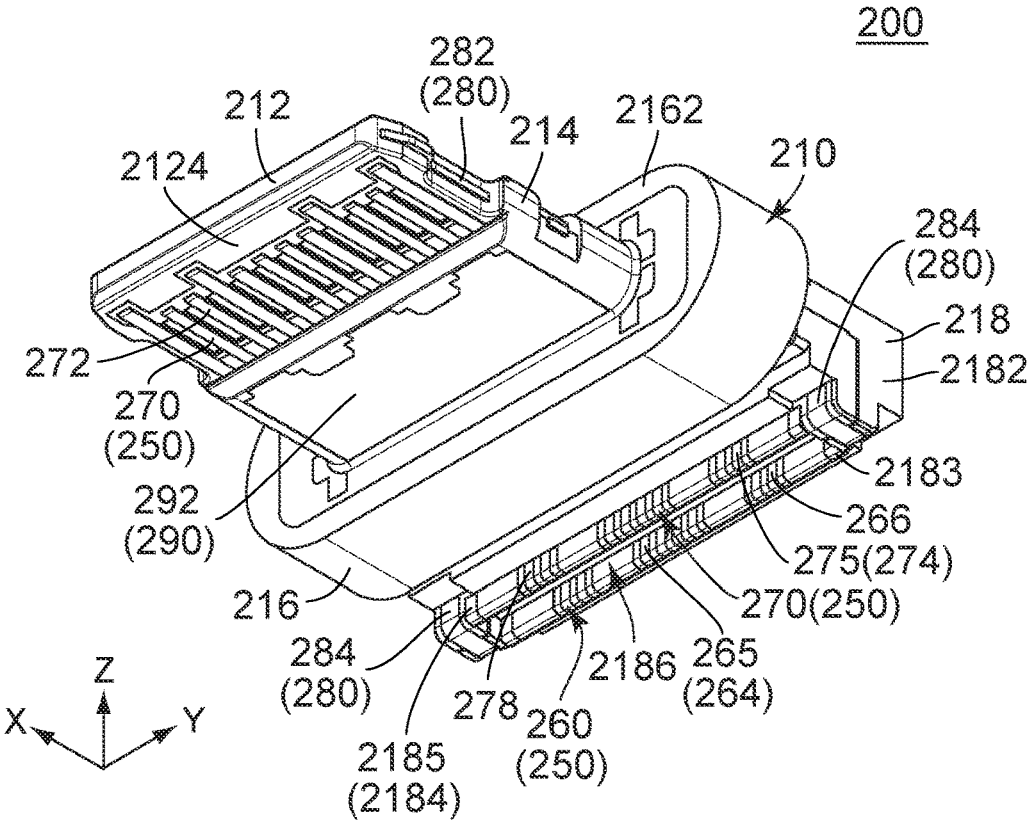
FIG. 9 is a bottom, perspective view showing the first sub connector of FIG. 8.

As shown in FIGS. 8 and 9, the first sub connector 200 of the present embodiment comprises a first holding member 210, a plurality of first terminals 250, a midplate 280 and ground plates 290.

Referring to FIG. 8, the first holding member 210 of the present embodiment is made of insulator. Specifically, the first holding member 210 has a plate-like portion 212, a base portion 216 and a first terminal holding portion 218. However, the present embodiment is not limited thereto. The first holding member 210 should have at least the plate-like portion 212.

Figure 13:
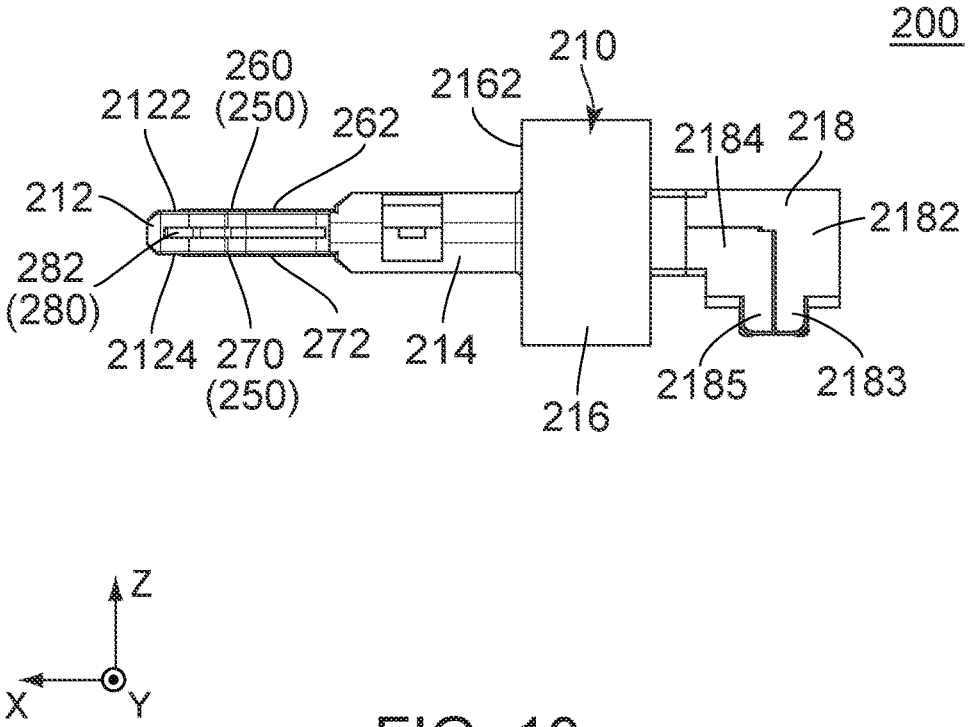
FIG. 13 is a side view showing the first sub connector of FIG. 8.

As shown in FIGS. 8 and 13, the plate-like portion 212 of the present embodiment has a substantially flat-plate shape perpendicular to the up-down direction. The plate-like portion 212 defines a front end of the first holding member 210. The plate-like portion 212 extends forward in the front-rear direction from the base portion 216. The plate-like portion 212 has an upper surface 2122, a lower surface 2124 and a middle portion 214.

As shown in FIG. 8, the upper surface 2122 of the present embodiment is a surface facing upward in the up-down direction.

As shown in FIG. 9, the lower surface 2124 of the present embodiment is a surface facing downward in the up-down direction. As shown in FIG. 13, the lower surface 2124 is positioned below the upper surface 2122 in the up-down direction.

As shown in FIG. 13, the middle portion 214 of the present embodiment defines a rear end of the plate-like portion 212. The middle portion 214 is connected with the base portion 216 in the front-rear direction.

Figure 12:
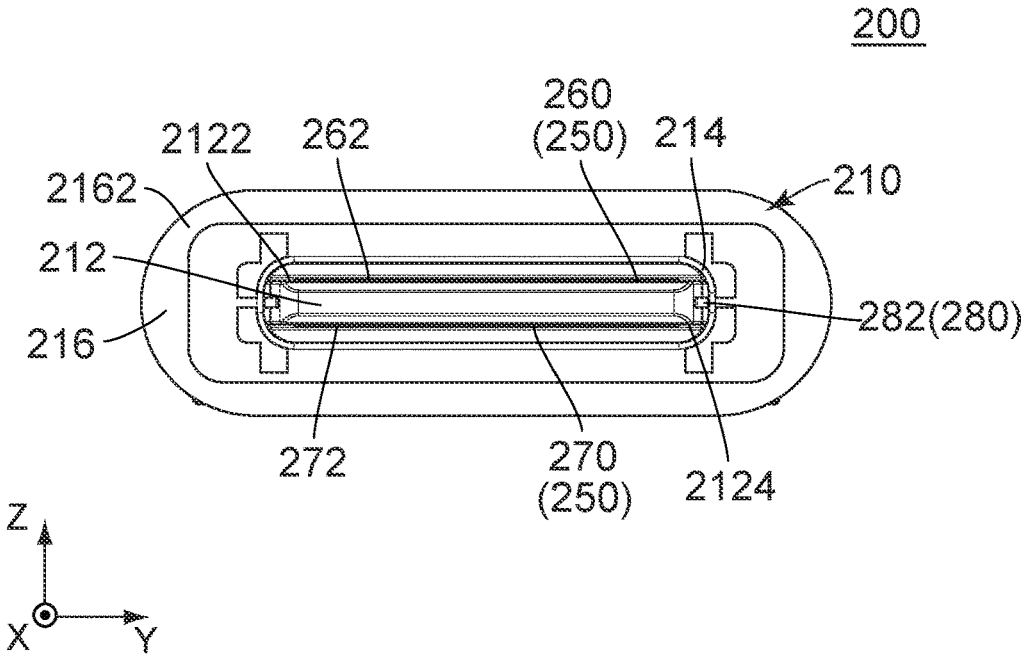
FIG. 12 is a front view showing the first sub connector of FIG. 8.

As shown in FIG. 8, the base portion 216 of the present embodiment is positioned rearward of the plate-like portion 212 in the front-rear direction. The base portion 216 is connected with the plate-like portion 212. As shown in FIG. 12, in a plane perpendicular to the front-rear direction, the base portion 216 has a size greater than a size of the plate-like portion 212. The base portion 216 has a front surface 2162. The front surface 2162 is a surface facing forward in the front-rear direction. The front surface 2162 is visible when the first sub connector 200 is viewed from its front.

Figure 10:
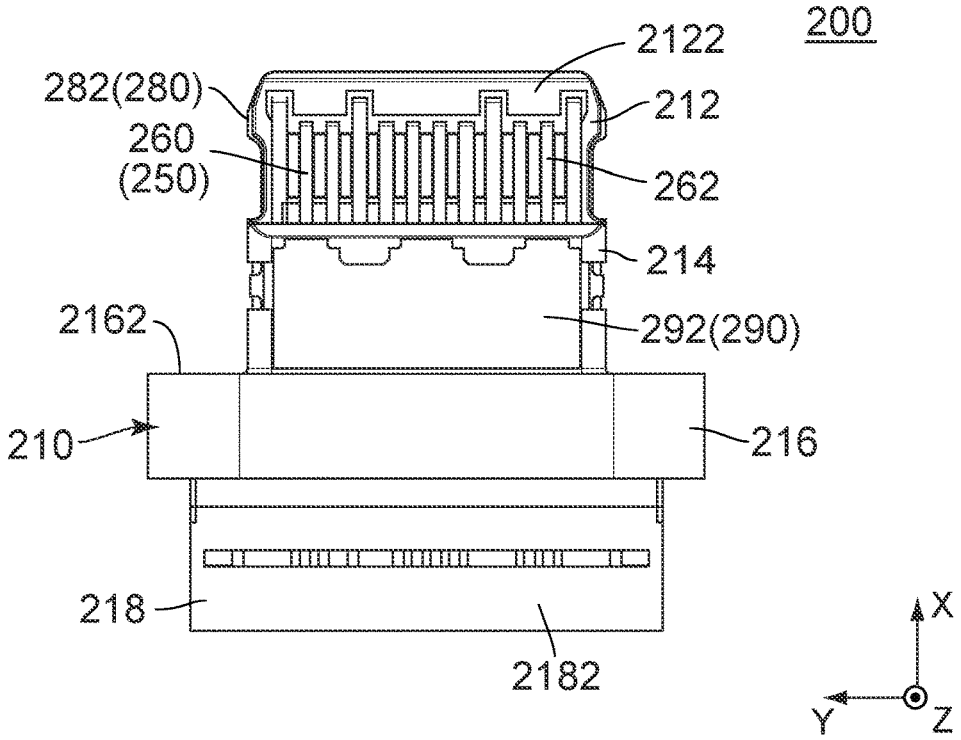
FIG. 10 is a top view showing the first sub connector of FIG. 8.

As shown in FIG. 10, the first terminal holding portion 218 of the present embodiment defines a rear end of the first holding member 210. A rear end of the base portion 216 is connected with a front end of the first terminal holding portion 218.

Figure 11:
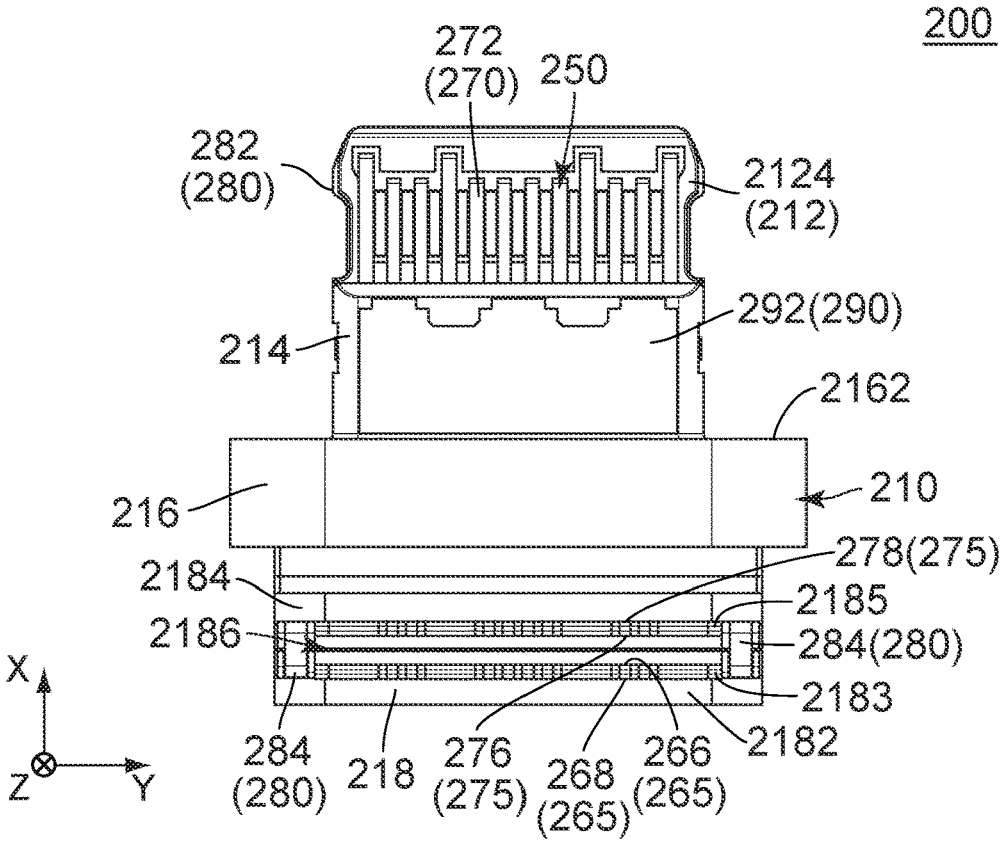
FIG. 11 is a bottom view showing the first sub connector of FIG. 8.

As shown in FIG. 11, the first terminal holding portion 218 of the present embodiment has an upper extending portion holding portion 2182, a lower extending portion holding portion 2184 and an island-like portion accommodating portion 2186.

As shown in FIG. 9, the upper extending portion holding portion 2182 of the present embodiment has a first upper contact point holding portion 2183. The first upper contact point holding portion 2183 protrudes downward in the up-down direction. The first upper contact point holding portion 2183 defines a lower end of the upper extending portion holding portion 2182.

As shown in FIG. 9, the lower extending portion holding portion 2184 of the present embodiment has a first lower contact point holding portion 2185. The first lower contact point holding portion 2185 protrudes downward in the up-down direction. The first lower contact point holding portion 2185 defines a lower end of the lower extending portion holding portion 2184.

As shown in FIG. 9, the island-like portion accommodating portion 2186 of the present embodiment is a recess which is recessed upward in the up-down direction. As shown in FIG. 11, the island-like portion accommodating portion 2186 is positioned between the first upper contact point holding portion 2183 and the first lower contact point holding portion 2185 in the front-rear direction.

Referring to FIGS. 8 and 9, each of the first terminals 250 of the present embodiment is made of conductor. The first terminals 250 are brought into contact with the mating terminals (not shown), respectively, when the connector 100 and the mating connector (not shown) are mated with each other. The first terminals 250 include a plurality of upper terminals 260 and a plurality of lower terminals 270. The upper terminals 260 correspond to the lower terminals 270, respectively.

Figure 5:
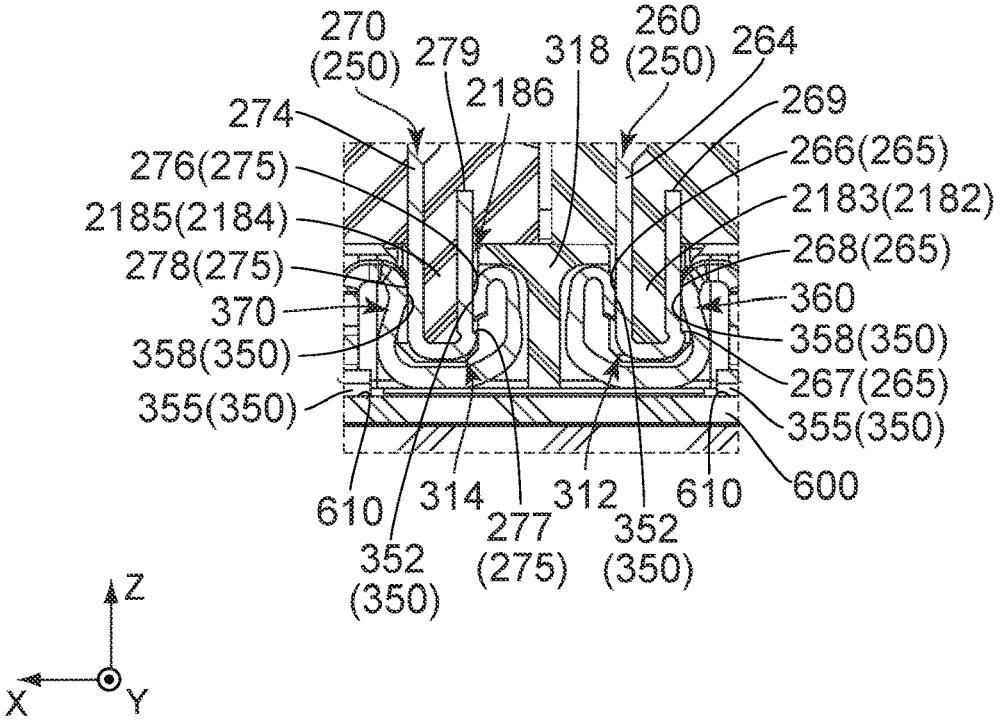
FIG. 5 is an enlarged, cross-sectional view showing a part of the electronic equipment which is surrounded by a rectangular frame B of FIG. 4.
Figure 15:
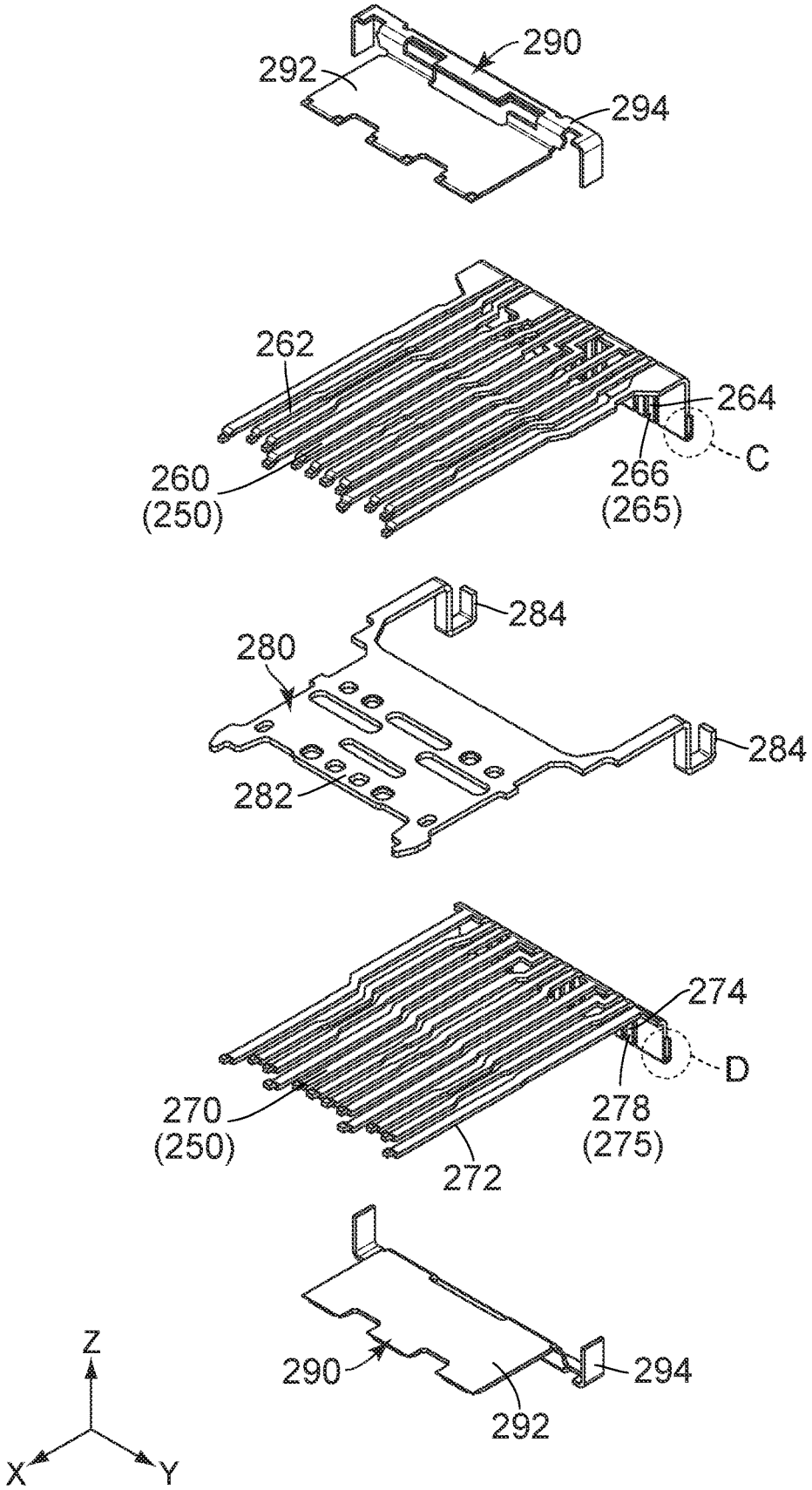
FIG. 15 is a perspective view showing first terminals, a midplate and ground plates which are included in the first sub connector of FIG. 8.

As shown in FIG. 8, the upper terminals 260 of the present embodiment are arranged in a pitch direction perpendicular to both the front-rear direction and the up-down direction. In the present embodiment, the pitch direction is a Y-direction. As shown in FIGS. 5 and 15, each of the upper terminals 260 has an upper contact portion 262, an upper extending portion 264, a first upper contact point 266, an upper step portion 267 and an auxiliary first upper contact point 268.

As shown in FIG. 8, the upper contact portion 262 of the present embodiment extends in the front-rear direction. The upper contact portion 262 is arranged on the upper surface 2122 of the plate-like portion 212. On the upper surface 2122 of the plate-like portion 212, the upper contact portion 262 is exposed to the outside of the first sub connector 200.

As shown in FIG. 5, the upper extending portion 264 of the present embodiment has a substantially U-shaped cross-section in a plane perpendicular to the pitch direction perpendicular to the front-rear direction. The upper extending portion 264 extends in a direction intersecting with the front-rear direction. More specifically, the upper extending portion 264 extends in the up-down direction perpendicular to both the front-rear direction and the pitch direction. The upper extending portion 264 has an end portion 265. The end portion 265 defines a lower end of the upper extending portion 264. The upper extending portion 264 is held by the upper extending portion holding portion 2182 of the first terminal holding portion 218. A free end 269 of the upper extending portion 264 is positioned around a rear end of the upper terminal 260 in the front-rear direction. The upper extending portion 264 extends downward, and is bent to extend rearward, and is further bent to extend upward. However, the present invention is not limited thereto. The upper extending portion 264 may be modified as follows; the upper extending portion 264 extends downward, and is bent to extend forward, and is further bent to extend upward.

As shown in FIG. 5, the first upper contact point 266 of the present embodiment is provided at the end portion 265 of the upper extending portion 264. The first upper contact point 266 faces inward in the front-rear direction. Specifically, the first upper contact point 266 faces forward in the front-rear direction. The first upper contact point 266 is a male contact which extends in a direction intersecting with the front-rear direction. More specifically, the first upper contact point 266 is the male contact which extends in the up-down direction perpendicular to both the front-rear direction and the pitch direction. The first upper contact point 266 is held by the first upper contact point holding portion 2183.

Figure 16:
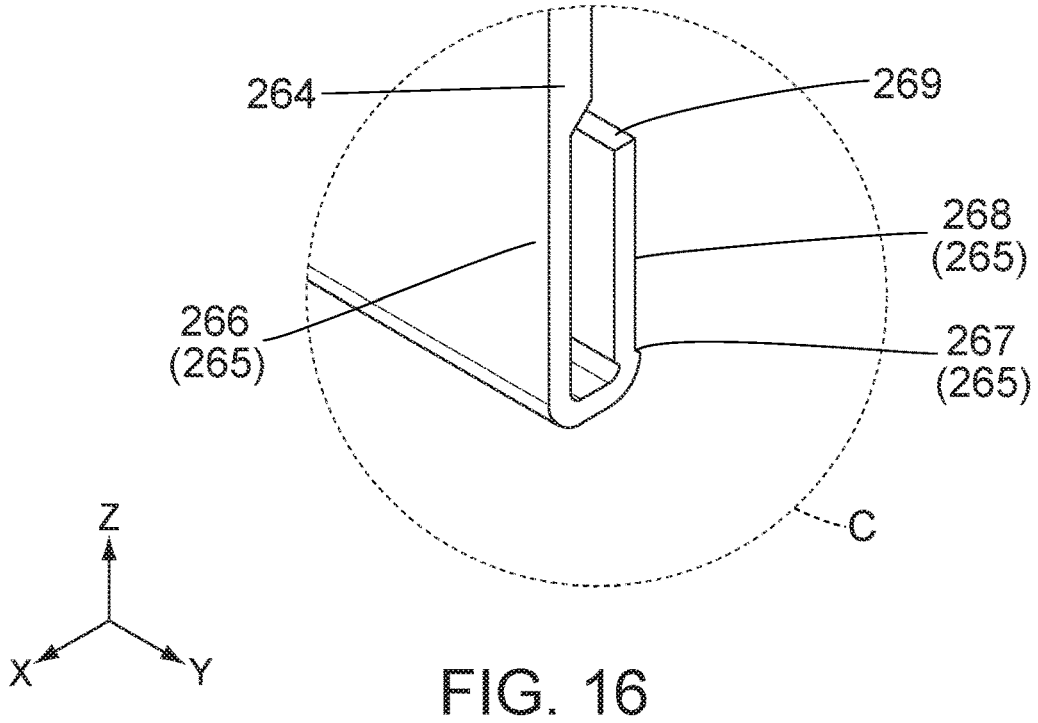
FIG. 16 is an enlarged view showing a part which is enclosed by dotted line C of FIG. 15.

As shown in FIGS. 5 and 16, the upper step portion 267 of the present embodiment is a slope which is oblique to both the up-down direction and the front-rear direction. More specifically, the upper step portion 267 is inclined rearward and downward. The upper step portion 267 is provided at the end portion 265 of the upper extending portion 264. The upper step portion 267 is positioned between the auxiliary first upper contact point 268 and the lower end of the upper extending portion 264 in the up-down direction. Specifically, in the up-down direction, the upper step portion 267 is positioned below the auxiliary first upper contact point 268 and above the lower end of the upper extending portion 264. A lower end of the upper step portion 267 is positioned rearward of the auxiliary first upper contact point 268 in the front-rear direction. A front end of the upper step portion 267 is connected with the auxiliary first upper contact point 268. The upper step portion 267 extends rearward in the front-rear direction from the auxiliary first upper contact point 268. However, the present invention is not limited thereto. The upper step portion 267 may be positioned between the first upper contact point 266 and the lower end of the upper extending portion 264 in the up-down direction. The upper step portion 267 may be provided at any part of the upper terminal 260 which slides on the second terminal 350 when the first sub connector 200 and the second sub connector 300 are mated with each other.

As shown in FIG. 5, the auxiliary first upper contact point 268 of the present embodiment is provided at the end portion 265 of the upper extending portion 264. The auxiliary first upper contact point 268 faces outward in the front-rear direction. Specifically, the auxiliary first upper contact point 268 faces rearward in the front-rear direction. The auxiliary first upper contact point 268 is coupled with the first upper contact point 266. The auxiliary first upper contact point 268 is a male contact which extends in a direction intersecting with the front-rear direction. More specifically, the auxiliary first upper contact point 268 is the male contact which extends in the up-down direction perpendicular to both the front-rear direction and the pitch direction. The auxiliary first upper contact point 268 is held by the first upper contact point holding portion 2183. The auxiliary first upper contact point 268 is positioned rearward of the first upper contact point 266 in the front-rear direction.

As shown in FIG. 9, the lower terminals 270 of the present embodiment are arranged in the pitch direction. As shown in FIGS. 5 and 15, each of the lower terminals 270 has a lower contact portion 272, a lower extending portion 274, a first lower contact point 276, a lower step portion 277 and an auxiliary first lower contact point 278.

As shown in FIG. 9, the lower contact portion 272 of the present embodiment extends in the front-rear direction. The lower contact portion 272 is arranged on the lower surface 2124 of the plate-like portion 212. On the lower surface 2124 of the plate-like portion 212, the lower contact portion 272 is exposed to the outside of the first sub connector 200.

As shown in FIG. 5, the lower extending portion 274 of the present embodiment has a substantially U-shaped cross-section in the plane perpendicular to the pitch direction perpendicular to the front-rear direction. The lower extending portion 274 extends in a direction intersecting with the front-rear direction. More specifically, the lower extending portion 274 extends in the up-down direction perpendicular to both the front-rear direction and the pitch direction. The lower extending portion 274 has an end portion 275. The end portion 275 defines a lower end of the lower extending portion 274. The lower extending portion 274 is held by the lower extending portion holding portion 2184 of the first terminal holding portion 218. A free end 279 of the lower extending portion 274 is positioned around a rear end of the lower terminal 270 in the front-rear direction. The lower extending portion 274 extends downward, and is bent to extend rearward, and is further bent to extend upward. However, the present invention is not limited thereto. The lower extending portion 274 may be modified as follows; the lower extending portion 274 extends downward, and is bent to extend forward, and is further bent to extend upward.

As shown in FIG. 5, the first lower contact point 276 of the present embodiment is provided at the end portion 275 of the lower extending portion 274. The first lower contact point 276 faces inward in the front-rear direction. Specifically, the first lower contact point 276 faces rearward in the front-rear direction. The first lower contact point 276 is a male contact which extends in a direction intersecting with the front-rear direction. More specifically, the first lower contact point 276 is the male contact which extends in the up-down direction perpendicular to the front-rear direction and the pitch direction. The first lower contact point 276 is held by the first lower contact point holding portion 2185.

Figure 14:
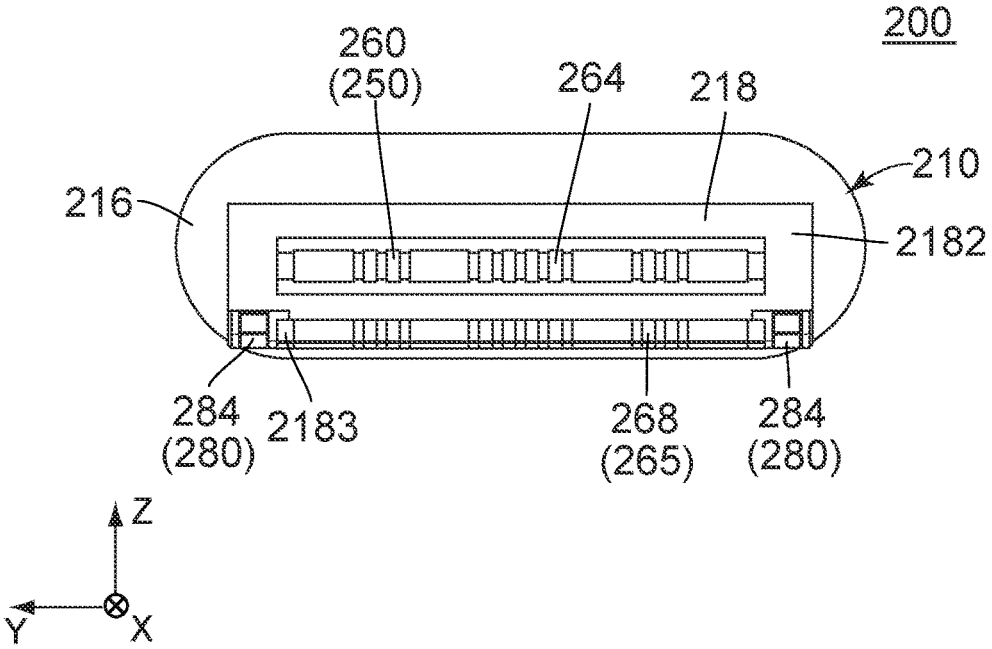
FIG. 14 is a rear view showing the first sub connector of FIG. 8.

As understood from FIGS. 11 and 14, when the first sub connector 200 is viewed from its rear in the front-rear direction, the first lower contact point 276 is invisible because the first lower contact point 276 is hidden by the first upper contact point 266. Specifically, the first upper contact points 266 correspond to the first lower contact points 276, respectively, and each of the first upper contact points 266 is positioned at a position same as a position of the first lower contact point 276 corresponding thereto in the pitch direction perpendicular to the front-rear direction.

Figure 17:
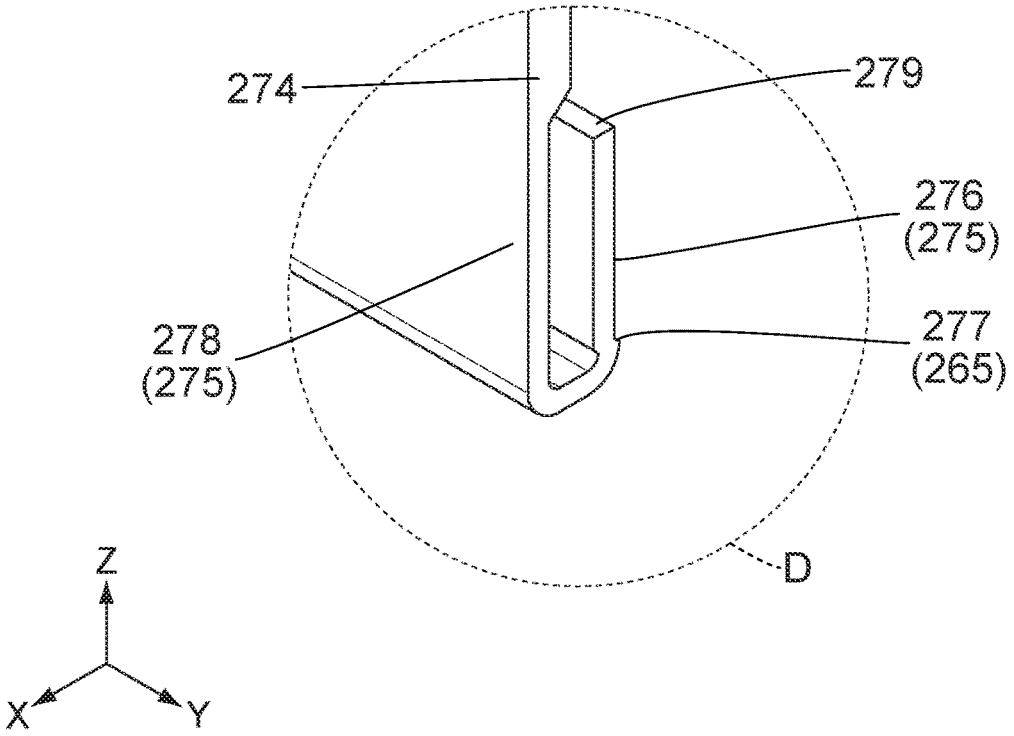
FIG. 17 is an enlarged view showing a part which is enclosed by dotted line D of FIG. 15.

As shown in FIGS. 5 and 17, the lower step portion 277 of the present embodiment is a slope which is oblique to both the up-down direction and the front-rear direction. More specifically, the lower step portion 277 is inclined rearward and downward. The lower step portion 277 is provided at the end portion 275 of the lower extending portion 274. The lower step portion 277 is positioned between the first lower contact point 276 and the lower end of the lower extending portion 274 in the up-down direction. Specifically, in the up-down direction, the lower step portion 277 is positioned below the first lower contact point 276 and above the lower end of the lower extending portion 274. A lower end of the lower step portion 277 is positioned rearward of the first lower contact point 276 in the front-rear direction. A front end of the lower step portion 277 is connected with the first lower contact point 276. The lower step portion 277 extends rearward in the front-rear direction from the first lower contact point 276. However, the present invention is not limited thereto. The lower step portion 277 may be positioned between the auxiliary first lower contact point 278 and the lower end of the lower extending portion 274 in the up-down direction. The lower step portion 277 may be provided at any part of the lower terminal 270 which slides on the second terminal 350 when the first sub connector 200 and the second sub connector 300 are mated with each other.

As shown in FIG. 5, the auxiliary first lower contact point 278 of the present embodiment is provided at the end portion 275 of the lower extending portion 274. The auxiliary first lower contact point 278 faces outward in the front-rear direction. Specifically, the auxiliary first lower contact point 278 faces forward in the front-rear direction. The auxiliary first lower contact point 278 is coupled with the first lower contact point 276. The auxiliary first lower contact point 278 is a male contact which extends in a direction intersecting with the front-rear direction. More specifically, the auxiliary first lower contact point 278 is the male contact which extends in the up-down direction perpendicular to both the front-rear direction and the pitch direction. The auxiliary first lower contact point 278 is held by the first lower contact point holding portion 2185. The auxiliary first lower contact point 278 is positioned forward of the first lower contact point 276 in the front-rear direction.

As shown in FIG. 11, the auxiliary first lower contact point 278 of each of the lower terminals 270 is positioned at a position same as a position of the auxiliary first upper contact point 268 of the upper terminal 260 corresponding thereto in the pitch direction perpendicular to the front-rear direction. More specifically, the first upper contact point 266, the auxiliary first upper contact point 268, the first lower contact point 276 and the auxiliary first lower contact point 278 are positioned at the same position as each other in the pitch direction.

Referring to FIG. 15, the midplate 280 of the present embodiment is made of metal. Specifically, the midplate 280 has a main portion 282 and two connecting portions 284.

As shown in FIG. 15, the main portion 282 of the present embodiment has a flat-plate shape perpendicular to the up-down direction.

As shown in FIG. 15, the connecting portions 284 of the present embodiment are positioned at opposite ends, respectively, of the main portion 282 in the pitch direction. Each of the connecting portions 284 extends rearward from a rear end of the main portion 282. As shown in FIG. 9, a lower end of the connecting portion 284 and its vicinity are exposed to the outside of the first sub connector 200 at a lower end of the first terminal holding portion 218.

As shown in FIG. 4, the midplate 280 is held by the first holding member 210 so as to be positioned between the upper contact portion 262 and the lower contact portion 272 in the up-down direction perpendicular to the front-rear direction. More specifically, the midplate 280 is held by the first holding member 210 so that the main portion 282 is positioned between the upper contact portion 262 and the lower contact portion 272 in the up-down direction.

Referring to FIG. 15, each of the ground plates 290 of the present embodiment is made of metal. Each of the ground plates 290 has a flat-plate portion 292 and a held portion 294.

As shown in FIG. 15, the flat-plate portion 292 of the present embodiment has a flat-plate shape perpendicular to the up-down direction. As shown in FIG. 8, the flat-plate portion 292 of the ground plate 290, which is positioned at an upper side of the first sub connector 200, is arranged on an upper surface of the middle portion 214 of the first holding member 210. As shown in FIG. 9, the flat-plate portion 292 of the ground plate 290, which is positioned at a lower side of the first sub connector 200, is arranged on a lower surface of the middle portion 214 of the first holding member 210.

As shown in FIG. 15, the held portion 294 of the present embodiment defines a rear end of the ground plate 290. As shown in FIG. 4, the held portion 294 is held by the base portion 216 of the first holding member 210.

Figure 18:
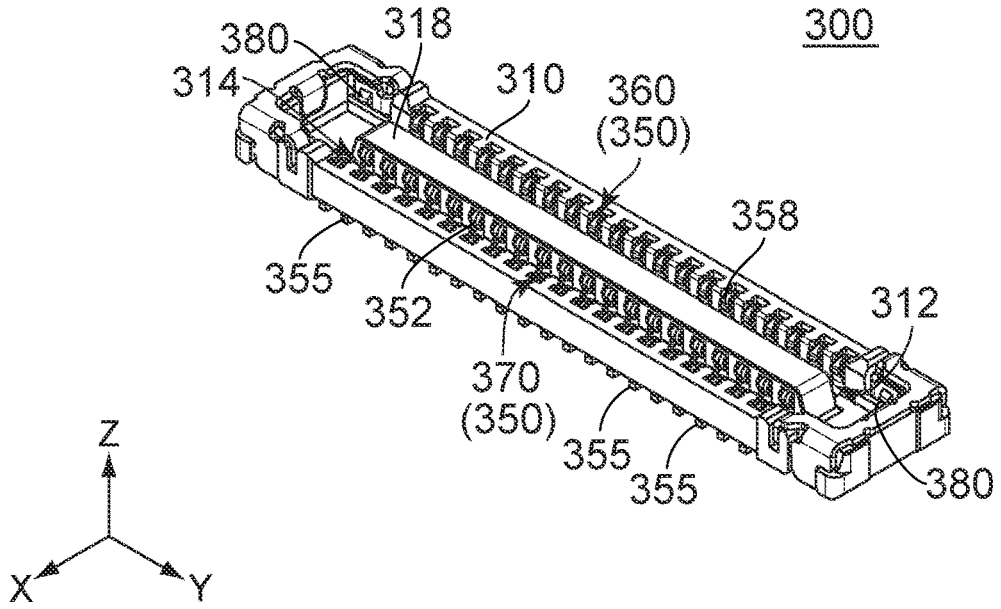
FIG. 18 is a perspective view showing a second sub connector which is included in the electronic equipment of FIG. 6.

As shown in FIG. 6, the second sub connector 300 of the present embodiment is configured to be mounted on the circuit board 600. As shown in FIG. 18, the second sub connector 300 comprises a second holding member 310, a plurality of second terminals 350 and connected portions 380.

Figure 19:
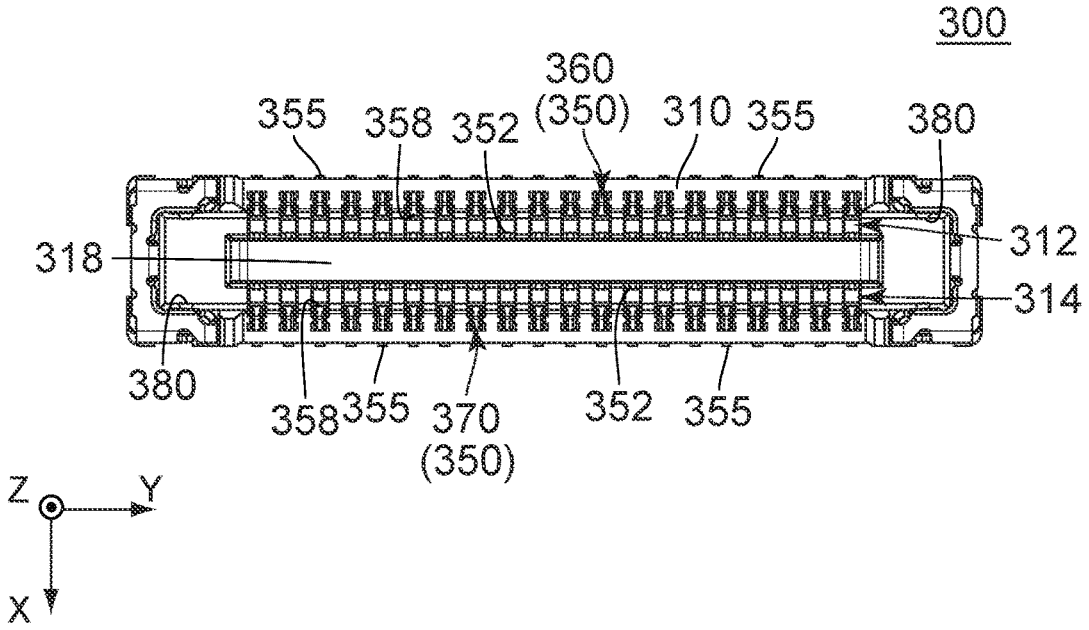
FIG. 19 is a top view showing the second sub connector of FIG. 18.

Referring FIG. 19, the second holding member 310 of the present embodiment is made of insulator. The second holding member 310 holds the second terminals 350. The second holding member 310 has an upper terminal accommodating portion 312, a lower terminal accommodating portion 314, and an island-like portion 318.

As shown in FIG. 18, the upper terminal accommodating portion 312 of the present embodiment is a space which is recessed downward in the up-down direction. The upper terminal accommodating portion 312 is positioned rearward of the lower terminal accommodating portion 314 in the front-rear direction. The upper terminal accommodating portion 312 is positioned rearward of the island-like portion 318 in the front-rear direction. As shown in FIG. 5, when the second sub connector 300 is mated with the first sub connector 200, the upper terminal accommodating portion 312 accommodates the first upper contact points 266, the auxiliary first upper contact points 268 and the first upper contact point holding portion 2183 of the first sub connector 200.

As shown in FIG. 18, the lower terminal accommodating portion 314 of the present embodiment is a space which is recessed downward in the up-down direction. As shown in FIG. 5, when the second sub connector 300 is mated with the first sub connector 200, the lower terminal accommodating portion 314 accommodates the first lower contact points 276, the auxiliary first lower contact points 278 and the first lower contact point holding portion 2185 of the first sub connector 200.

As shown in FIG. 18, the island-like portion 318 of the present embodiment protrudes upward in the up-down direction. As shown in FIG. 19, the island-like portion 318 is positioned between the upper terminal accommodating portion 312 and the lower terminal accommodating portion 314 in the front-rear direction. As shown in FIG. 5, when the second sub connector 300 is mated with the first sub connector 200, the island-like portion 318 is accommodated in the island-like portion accommodating portion 2186 of the first sub connector 200.

Referring to FIG. 19, each of the second terminals 350 of the present embodiment is made of conductor. The second terminals 350 are arranged in two rows 360, 370. More specifically, the second terminals 350 of each of the two rows 360, 370 are arranged in the pitch direction. The second terminal 350 of the row 360, i.e. one of the two rows 360, 370, is positioned rearward of the second terminal 350 of the row 370, i.e. a remaining one of the two rows 360, 370, in the front-rear direction. The second terminals 350 of the row 360 correspond to the upper terminals 260, respectively. The second terminals 350 of the remaining row 370 correspond to the lower terminals 270, respectively.

As shown in FIG. 18, each of the second terminals 350 of the present embodiment has a second contact point 352, a surface mount technology (SMT) portion 355 and an auxiliary second contact point 358.

As shown in FIG. 5, the second contact point 352 of the present embodiment is a female contact. When the first sub connector 200 and the second sub connector 300 are mated with each other, the female contact 352 receives the male contact 266 or the male contact 276 and is brought into contact with the male contact 266 or the male contact 276. The second contact point 352 is resiliently displaceable in the front-rear direction.

As shown in FIG. 5, the auxiliary second contact point 358 of the present embodiment is a female contact. When the first sub connector 200 and the second sub connector 300 are mated with each other, the female contact 358 receives the auxiliary first upper contact point 268 or the auxiliary first lower contact point 278 and is brought into contact with the auxiliary first upper contact point 268 or the auxiliary first lower contact point 278. The auxiliary second contact point 358 is resiliently displaceable in the front-rear direction. The auxiliary second contact point 358 is positioned outward of the second contact point 352 in the front-rear direction. The second contact point 352 and the auxiliary second contact point 358 face each other in the front-rear direction. The second contact point 352 and the auxiliary second contact point 358 are positioned at the same position as each other in the pitch direction.

Referring to FIGS. 5 and 16, the second sub connector 300 of the present embodiment is configured so that, when the first sub connector 200 and the second sub connector 300 are mated with each other, the auxiliary second contact point 358 of the second terminal 350 of the row 360 of the two rows 360, 370 rides over the upper step portion 267 and is then brought into contact with the auxiliary first upper contact point 268. Referring to FIGS. 5 and 17, when the first sub connector 200 and the second sub connector 300 are mated with each other, the second contact point 352 of the second terminal 350 of the remaining row 370 of the two rows 360, 370 rides over the lower step portion 277 and is then brought into contact with the first lower contact point 276. Thus, the riding over provides a clicking sensation to a user when the user mates the first sub connector 200 and the second sub connector 300 to each other.

As shown in FIG. 5, the second sub connector 300 of the present embodiment is configured so that the second contact point 352 of the second terminal 350 of the row 360 of the two rows 360, 370 is brought into contact with the first upper contact point 266 under a mated state where the first sub connector 200 and the second sub connector 300 are mated with each other. Specifically, the second contact point 352 of the second terminal 350 of the row 360 is brought into direct contact with the first upper contact point 266 under the mated state where the first sub connector 200 and the second sub connector 300 are mated with each other. As described above, the first upper contact point 266 is the male contact which extends in the direction intersecting with the front-rear direction. Accordingly, the first upper contact point 266 has an effective contact length which is sufficient in the direction intersecting with the front-rear direction. In other words, a part of the first upper contact point 266 that can be brought into contact with the second contact point 352 extends long in the direction intersecting with the front-rear direction. The second contact points 352 of the second terminals 350 of the row 360 may be brought into one-to-one contact with the first upper contact points 266. Additionally, the second contact points 352 of the second terminals 350 of the row 360 may be simultaneously brought into contact with the common first upper contact point 266. The second contact point 352 of the second terminal 350 of the remaining row 370 of the two rows 360, 370 is brought into contact with the first lower contact point 276 under the mated state where the first sub connector 200 and the second sub connector 300 are mated with each other. Specifically, the second contact point 352 of the second terminal 350 of the remaining row 370 is brought into direct contact with the first lower contact point 276 under the mated state where the first sub connector 200 and the second sub connector 300 are mated with each other. As described above, the first lower contact point 276 is the male contact which extends in the direction intersecting with the front-rear direction. Accordingly, the first lower contact point 276 has an effective contact length which is sufficient in the direction intersecting with the front-rear direction. In other words, a part of the first lower contact point 276 that can be brought into contact with the second contact point 352 extends long in the direction intersecting with the front-rear direction. The second contact points 352 of the second terminals 350 of the remaining row 370 may be brought into one-to-one contact with the first lower contact points 276. Additionally, the second contact points 352 of the second terminals 350 of the remaining row 370 may be simultaneously brought into contact with the common first lower contact point 276.

As shown in FIG. 5, the second sub connector 300 of the present embodiment is configured so that the auxiliary second contact point 358 of the second terminal 350 of the row 360 of the two rows 360, 370 is brought into contact with the auxiliary first upper contact point 268 under the mated state where the first sub connector 200 and the second sub connector 300 are mated with each other. Specifically, the auxiliary second contact point 358 of the second terminal 350 of the row 360 is brought into direct contact with the auxiliary first upper contact point 268 under the mated state where the first sub connector 200 and the second sub connector 300 are mated with each other. As described above, the auxiliary first upper contact point 268 is the male contact which extends in the direction intersecting with the front-rear direction. Accordingly, the auxiliary first upper contact point 268 has an effective contact length which is sufficient in the direction intersecting with the front-rear direction. In other words, a part of the auxiliary first upper contact point 268 that can be brought into contact with the auxiliary second contact point 358 extends long in the direction intersecting with the front-rear direction. The auxiliary second contact points 358 of the second terminals 350 of the row 360 may be brought into one-to-one contact with the auxiliary first upper contact points 268. Additionally, the auxiliary second contact points 358 of the second terminals 350 of the row 360 may be simultaneously brought into contact with the common auxiliary first upper contact point 268. The auxiliary second contact point 358 of the second terminal 350 of the remaining row 370 of the two rows 360, 370 is brought into contact with the auxiliary first lower contact point 278 under the mated state where the first sub connector 200 and the second sub connector 300 are mated with each other. Specifically, the auxiliary second contact point 358 of the second terminal 350 of the remaining row 370 is brought into direct contact with the auxiliary first lower contact point 278 under the mated state where the first sub connector 200 and the second sub connector 300 are mated with each other. As described above, the auxiliary first lower contact point 278 is the male contact which extends in the direction intersecting with the front-rear direction. Accordingly, the auxiliary first lower contact point 278 has an effective contact length which is sufficient in the direction intersecting with the front-rear direction. In other words, a part of the auxiliary first lower contact point 278 that can be brought into contact with the auxiliary second contact point 358 extends long in the direction intersecting with the front-rear direction. The auxiliary second contact points 358 of the second terminals 350 of the remaining row 370 may be brought into one-to-one contact with the auxiliary first lower contact points 278. Additionally, the auxiliary second contact points 358 of the second terminals 350 of the remaining row 370 may be simultaneously brought into contact with the common auxiliary first lower contact point 278.

As shown in FIG. 18, the second terminals 350 of the present embodiment are arranged at regular intervals in the pitch direction. An interval between the second terminals 350 of the row 360 may, however, be modified in accordance with a pitch interval between the first upper contact points 266 of the upper terminals 260 corresponding thereto. Similarly, an interval between the second terminals 350 of the remaining row 370 may be modified in accordance with a pitch interval between the first lower contact points 276 of the lower terminals 270 corresponding thereto.

As described above, the first sub connector 200 is configured so that each of the first upper contact points 266 is positioned at the same position as the first lower contact point 276 corresponding thereto in the pitch direction perpendicular to the front-rear direction. More specifically, the first upper contact point 266, the auxiliary first upper contact point 268, the first lower contact point 276 and the auxiliary first lower contact point 278 are positioned at the same position as each other in the pitch direction. Accordingly, in the second sub connector 300 mateable with the first sub connector 200, an arrangement of the second terminals 350 of the row 360 and an arrangement of the second terminals 350 of the remaining row 370 occupy the same extent in the pitch direction. Thus, the second sub connector 300 can have a minimized size in the pitch direction.

As described above, the connector 100 is configured as follows: the first sub connector 200 and the second sub connector 300 are mateable with each other in the direction intersecting with the front-rear direction; each of the first upper contact point 266 and the first lower contact point 276 of the first sub connector 200 has the effective contact length which is sufficient in the direction intersecting with the front-rear direction; and each of the auxiliary first upper contact point 268 and the auxiliary first lower contact point 278 of the first sub connector 200 has the effective contact length which is sufficient in the direction intersecting with the front-rear direction. In other words, the part of each of the first upper contact point 266 and the first lower contact point 276 of the first sub connector 200 that can be brought into contact with the second contact point 352 extends in the direction intersecting with the front-rear direction, and the part of each of the auxiliary first upper contact point 268 and the auxiliary first lower contact point 278 of the first sub connector 200 that can be brought into contact with the auxiliary second contact point 358 extends in the direction intersecting with the front-rear direction. These enable the first sub connector 200 and the second sub connector 300 to be appropriately connected with each other even if the first sub connector 200 and the second sub connector 300 are mated with each other while the first sub connector 200 and the second sub connector 300 are slightly misaligned from each other in the direction intersecting with the front-rear direction. In addition, each of the second contact point 352 and the auxiliary second contact point 358 of the second sub connector 300 is resiliently displaceable in the front-rear direction, and the second contact point 352 and the auxiliary second contact point 358 face each other in the front-rear direction. These enable the first sub connector 200 and the second sub connector 300 to be appropriately connected with each other even if the first sub connector 200 and the second sub connector 300 are mated with each other while the first sub connector 200 and the second sub connector 300 are slightly misaligned from each other in the front-rear direction. Specifically, even in a case where the first sub connector 200 and the second sub connector 300 are mated with each other while the first sub connector 200 is slightly misaligned forward from the second sub connector 300, the auxiliary first lower contact point 278 is brought into contact with the auxiliary second contact point 358 while the first upper contact point 266 is brought into contact with the second contact point 352. Thus, the first sub connector 200 and the second sub connector 300 can be appropriately connected with each other even in this case. Similarly, even in a case where the first sub connector 200 and the second sub connector 300 are mated with each other while the first sub connector 200 is slightly misaligned rearward from the second sub connector 300, the first lower contact point 276 is brought into contact with the second contact point 352 while the auxiliary first upper contact point 268 is brought into contact with the auxiliary second contact point 358. Thus, the first sub connector 200 and the second sub connector 300 can be appropriately connected with each other even in this case.

Figure 20:
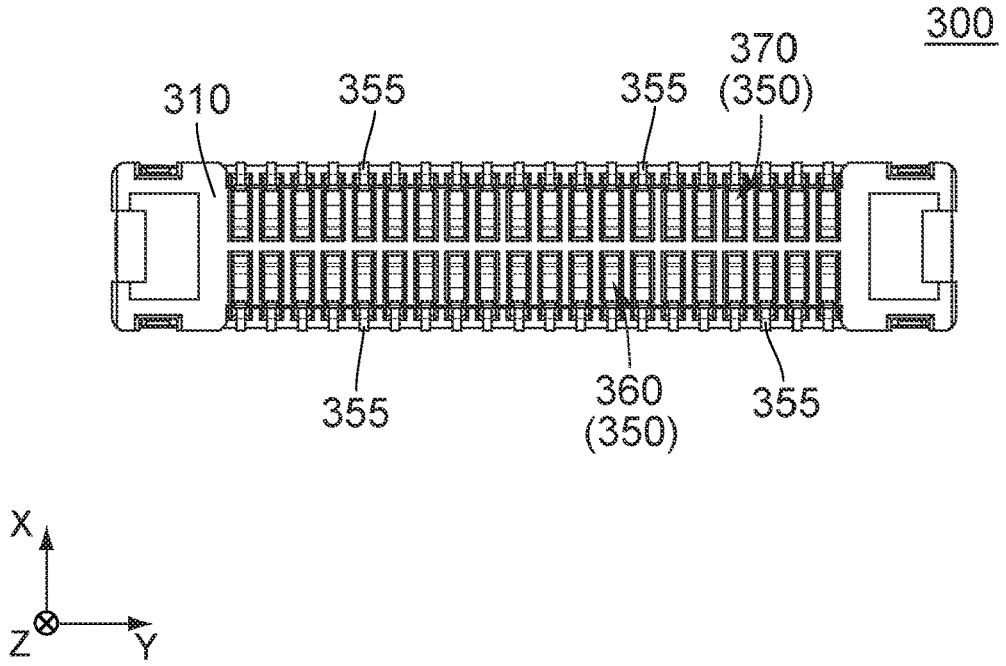
FIG. 20 is a bottom view showing the second sub connector of FIG. 18.
Figure 21:
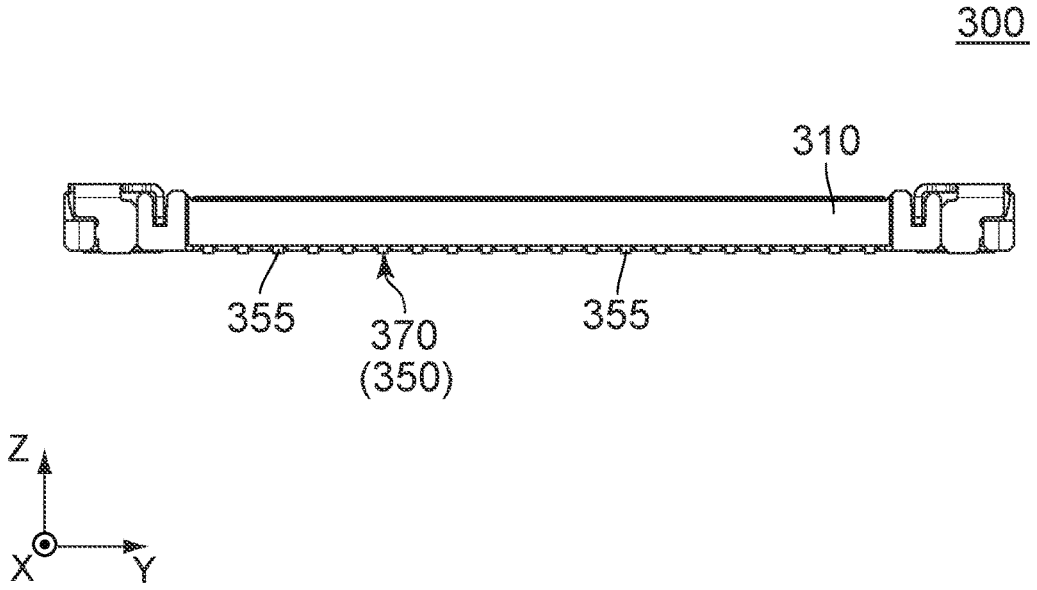
FIG. 21 is a side view showing the second sub connector of FIG. 18.

As shown in FIG. 5, the SMT portion 355 of the present embodiment is configured to be fixed on the circuit board 600. As shown in FIG. 20, the SMT portion 355 of the second terminal 350 of the row 360 extends in an orientation opposite to an orientation in which the SMT portion 355 of the second terminal 350 of the remaining row 370 extends. The direction in which the SMT portion 355 extends is the front-rear direction. More specifically, the SMT portion 355 of the second terminal 350 of the row 360 extends rearward, and the SMT portion 355 of the second terminal 350 of the remaining row 370 extends forward.

Referring to FIG. 19, each of the connected portions 380 of the present embodiment is made of metal. Each of the connected portions 380 faces inward in the front-rear direction. As understood from FIGS. 14 and 19, when the second sub connector 300 is mated with the first sub connector 200, the connected portion 380 is connected with the connecting portion 284 of the midplate 280 of the first sub connector 200.

Figure 3:
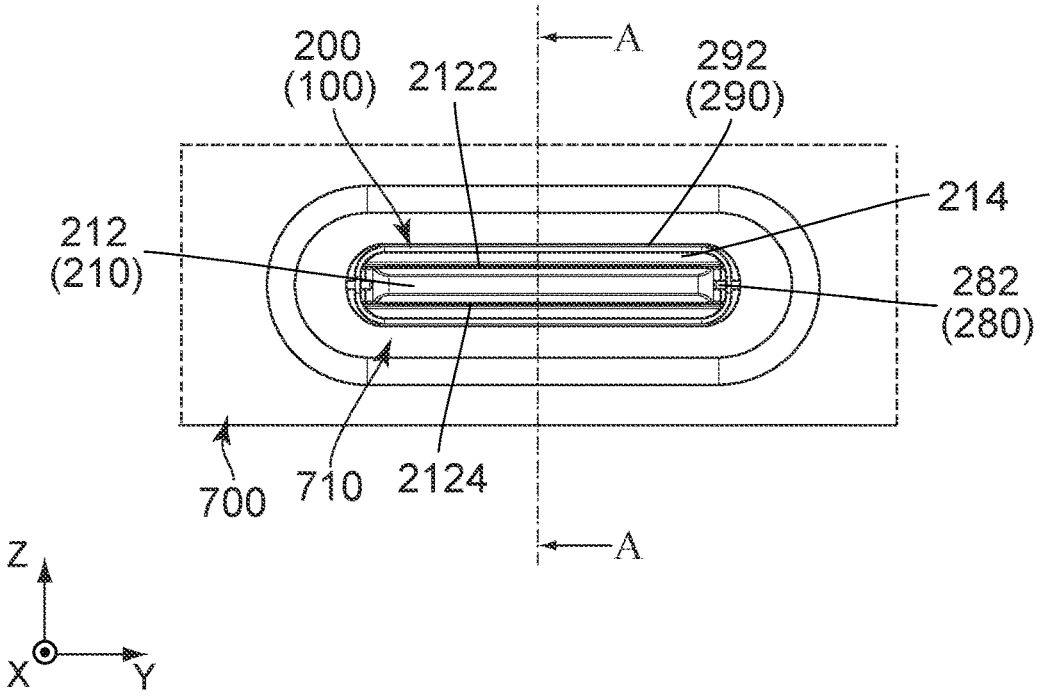
FIG. 3 is a front view showing a part of the electronic equipment of FIG. 2.

As shown in FIGS. 2, 3 and 6, the housing 700 of the present embodiment is provided with a receiving portion 710 which communicates with the outside of the housing 700. The receiving portion 710 opens forward in the front-rear direction. The plate-like portion 212 of the first holding member 210 of the first sub connector 200 is positioned in the receiving portion 710. The receiving portion 710 surrounds the plate-like portion 212 in the plane perpendicular to the front-rear direction. A front end of the receiving portion 710 is positioned forward beyond a front end of the plate-like portion 212.

Referring to FIGS. 2 and 6, the housing 700 has a shell 750 and a connecting hole (not shown). The shell 750 is positioned in the receiving portion 710. However, the present invention is not limited thereto. Specifically, the housing 700 may have no shell 750.

The connecting hole of the present embodiment is a hole piercing the receiving portion 710 in the front-rear direction. The connecting hole communicates the receiving portion 710 and an inside space of the housing 700 with each other in the front-rear direction. A part of the middle portion 214 of the first holding member 210 of the first sub connector 200 is positioned in the connecting hole.

Referring to FIGS. 2 and 6, the shell 750 of the present embodiment is made of conductive member. The shell 750 is arranged on an inner surface of the receiving portion 710. The shell 750 surrounds the plate-like portion 212 in the plane perpendicular to the front-rear direction. Since the housing 700 has the shell 750, electrical noise generated in the first sub connector 200 can be strongly prevented from being emitted.

As shown in FIGS. 2 and 6, the connector 100 of the present embodiment is attached to the housing 700 by the connector 100 being inserted into the connecting hole of the housing 700 from a rear side of the connecting hole. The electronic equipment 400 is provided with an adhesive member (not shown) between the housing 700 and the base portion 216 of the first holding member 210 of the first sub connector 200 of the connector 100. The base portion 216 of the first holding member 210 of the first sub connector 200 is attached to the housing 700 by the adhesive member. In other words, the connector 100 is attached to the housing 700 by the adhesive member. Thus, the electronic equipment 400 can be assembled in the following simpler order: the first sub connector 200 is attached to the housing 700 by the adhesive member; the second sub connector 300 is fixed on the circuit board 600; and the first sub connector 200 and the second sub connector 300 are mated with each other. The aforementioned adhesive member may be, for example, a double-sided tape or an epoxy-based glue. Additionally, the adhesive member may be selected from any kind of materials that can adhere the connector 100 and the housing 700 to each other.

As shown in FIG. 5, the circuit board 600 of the present embodiment has pads 610. The SMT portion 355 of the second terminal 350 of the second sub connector 300 is soldered on the pad 610. Referring to FIG. 2, the circuit board 600 is attached to an inside of the housing 700.

The structures of the connector 100 is not limited thereto. For example, the connector 100 can be modified as described below.

Figure 22:
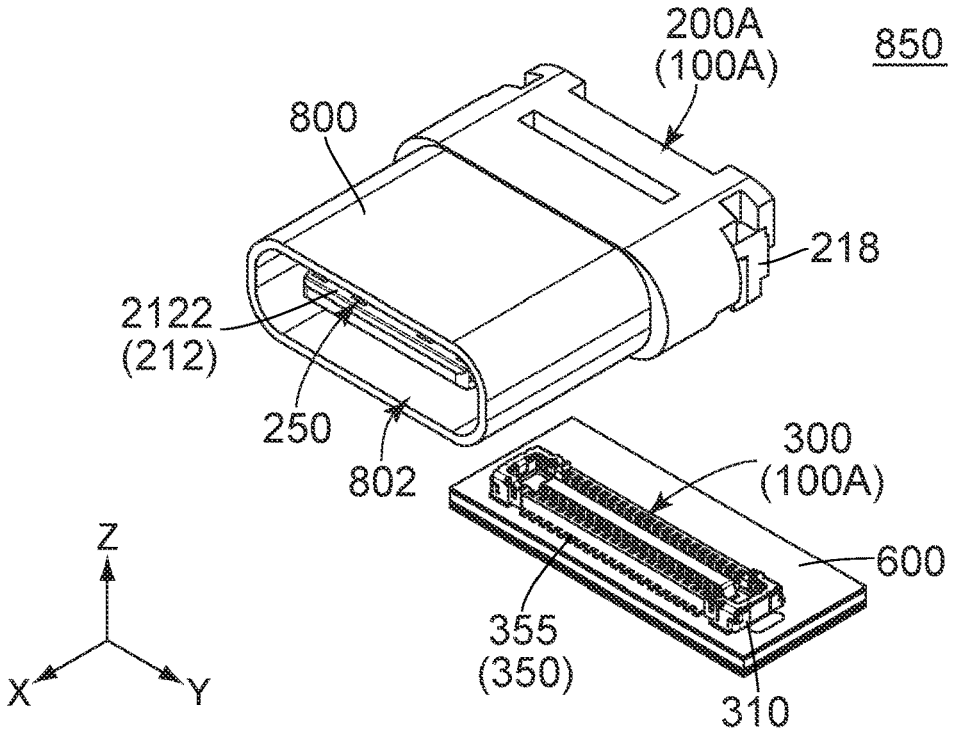
FIG. 22 is an exploded, perspective view showing a connector assembly which comprises the circuit board and a modification of the connector included in the electronic equipment of FIG. 2. In the figure, a first sub connector of the modification of the connector comprises a shell.
Figure 23:
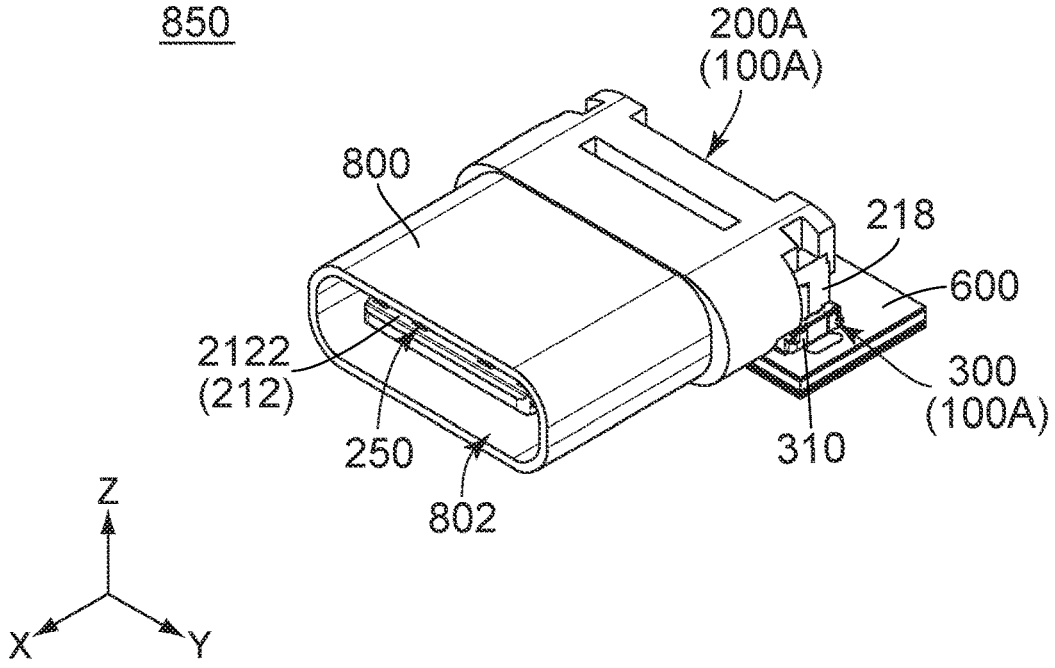
FIG. 23 is a top, perspective view showing the connector assembly of FIG. 22.
Figure 24:
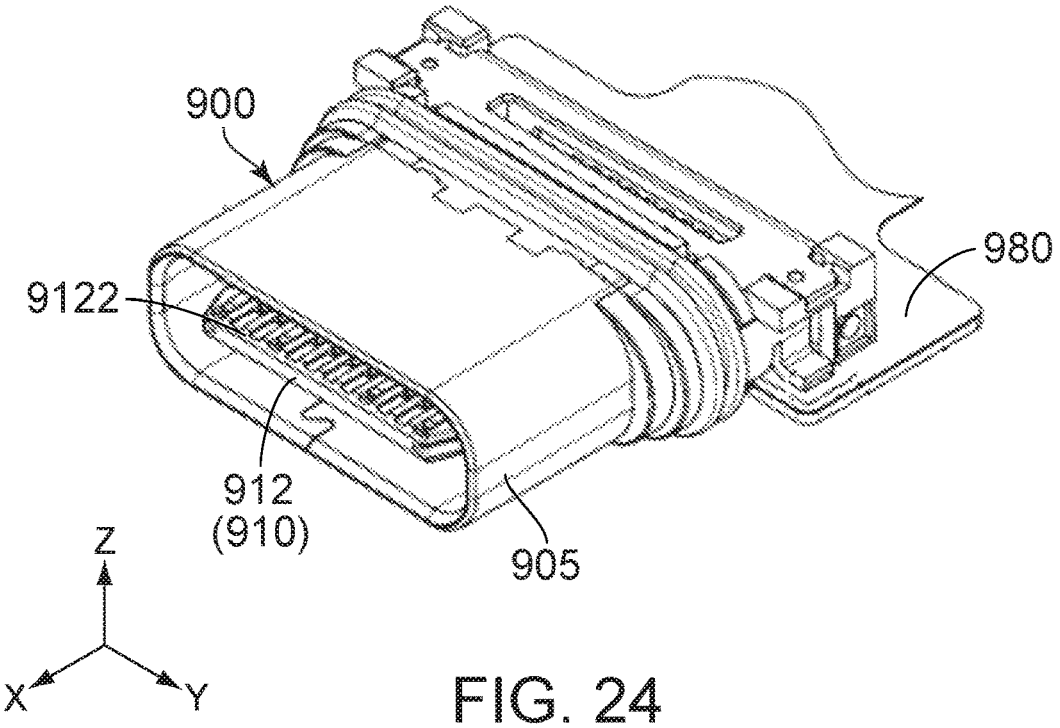
FIG. 24 PRIOR ART
FIG. 24 is a perspective view showing a connector of Patent Document 1. In the figure, the connector is mounted on a circuit board.
Figure 25:
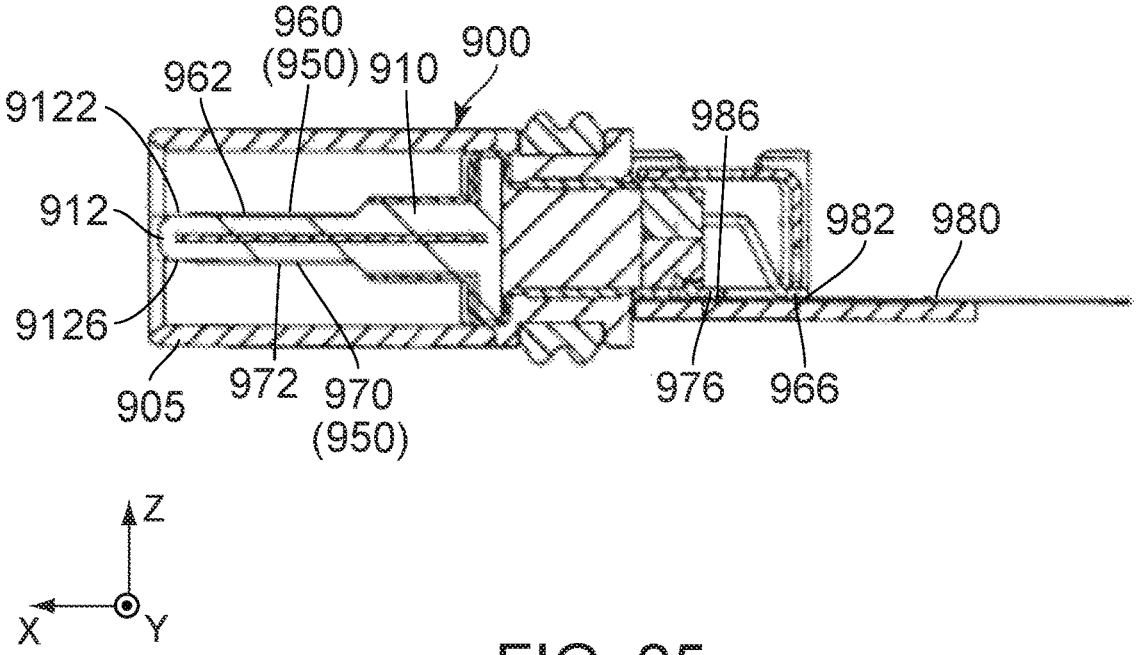
FIG. 25 PRIOR ART
FIG. 25 is a cross-sectional view showing the connector of FIG. 24.

As shown in FIGS. 22 and 23, a connector assembly 850 according to an embodiment of the present invention comprises a connector 100A according to a modification of the present embodiment and a circuit board 600. The circuit board 600 of the present embodiment has a structure same as that of the circuit board 600 of the aforementioned electronic equipment 400. Accordingly, a detailed explanation thereabout is omitted.

As shown in FIGS. 22 and 23, the connector 100A of the present embodiment comprises a first sub connector 200A and a second sub connector 300. The second sub connector 300 of the present embodiment has a structure same as that of the second sub connector 300 of the aforementioned electronic equipment 400. Accordingly, a detailed explanation thereabout is omitted. The first sub connector 200A of the present embodiment has a structure similar to that of the first sub connector 200 of the aforementioned electronic equipment 400 except for having a shell 800. Accordingly, components similar to those of the first sub connector 200 of the aforementioned electronic equipment 400 among components of the present embodiment will be designated by the same reference numerals as those of the first sub connector 200 of the aforementioned electronic equipment 400, and detail explanation thereabout will be omitted.

Referring to FIGS. 22 and 23, the shell 800 of the present embodiment is made of metal. The shell 800 opens at its front end in the front-rear direction. In other words, the shell 800 has an opening 802 at the front end. The shell 800 has a substantially track-shape when the connector assembly 850 is viewed from its front. The shell 800 surrounds the flat-plate portion 292 of the ground plate 290 in the plane perpendicular to the front-rear direction. The shell 800 surrounds the plate-like portion 212 of the first holding member 210 in the plane perpendicular to the front-rear direction. The shell 800 surrounds all of the upper contact portions 262 and the lower contact portions 272 in the plane perpendicular to the front-rear direction.

Although the specific explanation about the present invention is made above referring to the embodiments, the present invention is not limited thereto and is susceptible to various modifications and alternative forms without departing from the spirit of the invention.

Although the connector 100 of the present embodiment is configured so that the first terminal 250 of the first sub connector 200 is a male terminal while the second terminal 350 of the second sub connector 300 is a female terminal, the present invention is not limited thereto. Specifically, the connector 100 may be configured so that the first terminal 250 of the first sub connector 200 is a female terminal while the second terminal 350 of the second sub connector 300 is a male terminal.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, the mating connector comprising a plurality of mating terminals, wherein:

the connector comprises a first sub connector and a second sub connector;

the first sub connector and the second sub connector are mateable with each other in a direction intersecting with the front-rear direction;

the first sub connector comprises a first holding member and a plurality of first terminals;

the first holding member has at least a plate-like portion;

the plate-like portion has an upper surface and a lower surface;

the first terminals are brought into contact with the mating terminals, respectively, when the connector and the mating connector are mated with each other;

the first terminals include a plurality of upper terminals and a plurality of lower terminals;

each of the upper terminals has an upper contact portion, an upper extending portion and a first upper contact point;

the upper contact portion extends in the front-rear direction and is arranged on the upper surface of the plate-like portion;

the upper extending portion extends in a direction intersecting with the front-rear direction;

the upper extending portion has an end portion;

the first upper contact point is provided at the end portion of the upper extending portion;

each of the lower terminals has a lower contact portion, a lower extending portion and a first lower contact point;

the lower contact portion extends in the front-rear direction and is arranged on the lower surface of the plate-like portion;

the lower extending portion extends in a direction intersecting with the front-rear direction;

the lower extending portion has an end portion;

the first lower contact point is provided at the end portion of the lower extending portion;

the second sub connector is configured to be mounted on a circuit board;

the second sub connector comprises a second holding member and a plurality of second terminals;

the second holding member holds the second terminals;

the second terminals are arranged in two rows;

each of the second terminals has a second contact point and an SMT portion;

the second contact point of the second terminal of one of the two rows is brought into contact with the first upper contact point under a mated state where the first sub connector and the second sub connector are mated with each other;

the second contact point of the second terminal of a remaining one of the two rows is brought into contact with the first lower contact point under the mated state where the first sub connector and the second sub connector are mated with each other;

the SMT portion is configured to be fixed on the circuit board; and the SMT portion of the second terminal of the one of the two rows extends in an orientation opposite to an orientation in which the SMT portion of the second terminal of the remaining one of the two rows extends.

2. The connector as recited in claim 1, wherein:

each of the first upper contact point and the first lower contact point is a male contact which extends in a direction intersecting with the front-rear direction;

the second contact point is a female contact; and when the first sub connector and the second sub connector are mated with each other, the female contact receives the male contact and is brought into contact with the male contact.

3. The connector as recited in claim 1, wherein the SMT portion extends in the front-rear direction.

4. The connector as recited in claim 1, wherein;

the first upper contact points correspond to the first lower contact points, respectively; and each of the first upper contact points is positioned at a position same as a position of the first lower contact point corresponding thereto in a pitch direction perpendicular to the front-rear direction.

5. The connector as recited in claim 1, wherein:

each of the upper terminals further has an auxiliary first upper contact point;

the auxiliary first upper contact point is positioned rearward of the first upper contact point in the front-rear direction;

each of the lower terminals further has an auxiliary first lower contact point;

the auxiliary first lower contact point is positioned forward of the first lower contact point in the front-rear direction;

each of the second terminals further has an auxiliary second contact point;

each of the second contact point and the auxiliary second contact point is resiliently deformable in the front-rear direction;

the auxiliary second contact point of the second terminal of one of the two rows is brought into contact with the auxiliary first upper contact point under the mated state where the first sub connector and the second sub connector are mated with each other; and the auxiliary second contact point of the second terminal of a remaining one of the two rows is brought into contact with the auxiliary first lower contact point under the mated state where the first sub connector and the second sub connector are mated with each other.

6. The connector as recited in claim 5, wherein:

each of the upper terminals has a rear end in the front-rear direction;

each of the upper terminals further has an upper step portion;

each of the lower terminals has a rear end in the front-rear direction;

each of the lower terminals further has a lower step portion;

the upper step portion extends rearward in the front-rear direction from the auxiliary first upper contact point;

the lower step portion extends rearward in the front-rear direction from the first lower contact point;

each of the upper extending portion and the lower extending portion has a substantially U-shaped cross-section in a plane perpendicular to a pitch direction perpendicular to the front-rear direction;

the upper extending portion has a free end which is positioned around the rear end of the upper terminal in the front-rear direction; and the lower extending portion has a free end which is positioned around the rear end of the lower terminal in the front-rear direction.

7. The connector as recited in claim 1, wherein:

the first sub connector has a shell; and the shell surrounds the plate-like portion in a plane perpendicular to the front-rear direction.

8. An electronic equipment comprising the connector as recited in claim 1, the circuit board and a housing, wherein:

the connector is mounted on the circuit board;

the circuit board is attached to an inside of the housing;

the housing is provided with a receiving portion which communicates with an outside of the housing; and the plate-like portion is positioned in the receiving portion.

9. The electronic equipment as recited in claim 8, wherein:

the housing has a shell;

the receiving portion has an inner surface;

the shell is arranged on the inner surface of the receiving portion; and the shell surrounds the plate-like portion in a plane perpendicular to the front-rear direction.

* * * * *